US009097997B2

(12) United States Patent
Nomura et al.

(10) Patent No.: US 9,097,997 B2
(45) Date of Patent: Aug. 4, 2015

(54) MAGNETIC TONER

(71) Applicant: CANON KABUSHIKI KAISHA, Tokyo (JP)

(72) Inventors: Shotaro Nomura, Suntou-gun (JP); Michihisa Magome, Mishima (JP); Yusuke Hasegawa, Suntou-gun (JP); Takashi Matsui, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/364,640

(22) PCT Filed: Jan. 31, 2013

(86) PCT No.: PCT/JP2013/052780
§ 371 (c)(1),
(2) Date: Jun. 11, 2014

(87) PCT Pub. No.: WO2013/115409
PCT Pub. Date: Aug. 8, 2013

(65) Prior Publication Data

US 2014/0335450 A1 Nov. 13, 2014

(30) Foreign Application Priority Data

Feb. 1, 2012 (JP) ..... 2012-019520

(51) Int. Cl.
*G03G 9/083* (2006.01)
*G03G 9/097* (2006.01)
*G03G 9/087* (2006.01)

(52) U.S. Cl.
CPC ..... *G03G 9/0833* (2013.01); *G03G 9/083* (2013.01); *G03G 9/087* (2013.01); *G03G 9/0836* (2013.01); *G03G 9/0839* (2013.01); *G03G 9/09708* (2013.01); *G03G 9/09725* (2013.01)

(58) Field of Classification Search
CPC ..... G03G 9/09725; G03G 9/09708; G03G 9/083; G03G 9/0833
USPC ..... 430/106.1, 106.2, 108.7, 108.6, 108.4
See application file for complete search history.

(56) References Cited

U.S. PATENT DOCUMENTS 5,066,558 A 11/1991 Hikake et al.
5,456,990 A * 10/1995 Takagi et al. ..... 430/106.1
6,270,937 B2 8/2001 Yuasa et al.
6,432,599 B1 8/2002 Yuasa et al.
6,780,557 B2 8/2004 Kawaji et al.

FOREIGN PATENT DOCUMENTS

JP 2-167561 A 6/1990
JP 4-145448 A 5/1992
JP 2000-10337 A 1/2000
JP 2001-281923 A 10/2001
JP 2003-173047 A 6/2003
JP 2003-177574 A 6/2003
JP 2006-17860 A 1/2006
JP 2007-33828 A 2/2007
JP 2007-57787 A 3/2007
JP 2008-015248 A * 1/2008
JP 4517915 B2 8/2010

OTHER PUBLICATIONS

European Patent Office machiine-assisted English-language translation of Japanese Patent Document JP 2008-015248 A (published Jan. 2008).*
Hasegawa, et al., U.S. Appl. No. 14/364,067, filed Jun. 9, 2014.
Magome, et al., U.S. Appl. No. 14/364,068, filed Jun. 9, 2014.
Hiroko, et al., U.S. Appl. No. 14/364,065, filed Jun. 9, 2014.
Suzumura, et al., U.S. Appl. No. 14/362,380, filed Jun. 2, 2014.
Matsui, et al., U.S. Appl. No. 14/362,377, filed Jun. 2, 2014.
Ohmori, et al., U.S. Appl. No. 14/364,633, filed Jun. 11, 2014.
Sano, et al., U.S. Appl. No. 14/364,636, filed Jun. 11, 2014.
Uratani, et al., U.S. Appl. No. 141364,634, filed Jun. 11, 2014.
Tanaka, et al., U.S. Appl. No. 14/364,638, filed Jun. 11, 2014.
PCT International Search Report and Written Opinion of the International Searching Authority, International Application No. JP2013/052780, Mailing Date Apr. 2, 2013.

* cited by examiner

*Primary Examiner* — Janis L Dote
(74) *Attorney, Agent, or Firm* — Fitzpatrick, Cella, Harper and Scinto

(57) ABSTRACT

A magnetic toner is provided that exhibits an excellent electrostatic offset resistance both initially and after long-term use. The magnetic toner contains: magnetic toner particles containing a binder resin and a magnetic body; and inorganic fine particles present on the surface of the magnetic toner particles, wherein the inorganic fine particles present on the surface of the magnetic toner particles contain a prescribed metal oxide fine particle in a prescribed proportion; the magnetic toner has prescribed numerical value ranges for a coverage ratio A of the magnetic toner particle surface covered by the inorganic fine particles and for a coverage ratio B by the inorganic fine particles that are fixed to the magnetic toner particle surface; the magnetic toner particle contains a crystalline polyester; and measurement of the magnetic toner with a differential scanning calorimeter provides a characteristic differential scanning calorimetric curve.

3 Claims, 7 Drawing Sheets

MAGNETIC TONER

TECHNICAL FIELD

The present invention relates to a magnetic toner for use in, for example, electrophotographic methods, electrostatic recording methods, and magnetic recording methods.

BACKGROUND ART

Image-forming apparatuses that use electrophotographic technology, e.g., copiers and printers, are currently in wide use. The image-forming method here comprises an electrostatic latent image-forming step, in which an electrostatic latent image is formed on a charged electrostatic latent image-bearing member; a development step, in which this electrostatic latent image is electrostatically developed by toner being carried on a toner-carrying member; a transfer step, in which the toner image on the electrostatic latent image-bearing member is transferred to a transfer material; and a fixing step, in which this toner image is fixed on a recording medium, e.g., paper, by the application of, e.g., heat or pressure.

Image-forming apparatuses that use electrophotographic technology, e.g., copiers and printers, have in recent years been experiencing increasing diversification in their intended applications and use environments. In combination with this, there is also strong demand for additional increases in speed and for an even longer service life.

However, when the apparatus is sped up, there may not be enough time for the toner on the toner-carrying member to be adequately charged, and as a consequence uniform charging of the toner may be impaired. This phenomenon becomes more significant during long-term use, during which the toner composition becomes increasingly nonuniform.

Various problems, such as a reduction in the development efficiency and a reduction in the transfer efficiency, are produced when the charge distribution on the toner becomes nonuniform. One of these problems is a type of phenomenon known as electrostatic offset.

Electrostatic offset is a phenomenon in which, prior to the unfixed image being fixed by the fixing apparatus, toner on the unfixed image flies to and attaches to locations on the fixing apparatus that are in contact with the unfixed image, as a consequence of which toner is fixed on the recording medium in a manner unrelated to the locations defined by the electrostatic latent image and image defects are thereby produced. Normally, the toner is electrostatically attached on the unfixed image and is also not electrically drawn to the contact locations of the fixing apparatus. However, toner with a charge opposite from the normal charge is sometimes produced when the charge distribution on the toner becomes nonuniform. An electrostatic force is produced between the oppositely charged toner and the contact locations of the fixing apparatus, and as a result the oppositely charged toner randomly flies over the contact regions and image defects are then ultimately produced. This phenomenon has been more significant in high-temperature, high-humidity environments, where toner charge leakage is induced and the production of charging defects is thereby facilitated.

Maintaining a uniform charge distribution is crucial for inhibiting electrostatic offset; however, even if the process of imparting charge to the toner on the toner-carrying member can somehow be strengthened, the charge is subsequently reduced in the transfer step and on the recording medium and it is thus quite difficult to completely prevent the appearance of nonuniformity. Due to this, there have been limits on the approach of completely suppressing the occurrence of oppositely charged toner.

Another approach that has been contemplated here is the inhibition of flight of the oppositely charged toner by causing a semi-melting of the toner on the unfixed image in the neighborhood of the fixing device in order to bring about toner unification or coalescence.

Specifically, numerous toners exist that contain a crystalline polyester that rapidly melts in response to heating of the toner (Patent Documents 1 to 4); however, none of these have achieved a satisfactory coalescence of the toner on the unfixed image and they have not been a satisfactory countermeasure to electrostatic offset. However, additional increments in the amount of a simple crystalline polyester end up producing various problems with, e.g., the charging performance and environmental stability.

Thus, there has been demand for a toner that can suppress electrostatic offset based on an approach from a novel perspective.

CITATION LIST

Patent Literature

[PTL 1] Japanese Patent Application Publication No. 2003-173047

[PTL 2] Japanese Patent Application Publication No. 2007-33828

[PTL 3] Japanese Patent Application Publication No. 2003-177574

[PTL 4] Japanese Patent Publication No. 4,517,915

SUMMARY OF INVENTION

Technical Problems

The present invention provides a magnetic toner that exhibits an excellent electrostatic offset resistance both initially and also after long-term use.

Solution to Problem

Thus, the present invention relates to a magnetic toner comprising: magnetic toner particles comprising a binder resin and a magnetic body; and inorganic fine particles present on the surface of the magnetic toner particles, wherein the inorganic fine particles present on the surface of the magnetic toner particles comprise metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein;

when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the magnetic toner has a coverage ratio A of at least 45.0% and not more than 70.0% and a ratio [coverage ratio B/coverage ratio A] of the coverage ratio B to the coverage ratio A of from at least 0.50 to not more than 0.85;

the magnetic toner particle contains a crystalline polyester; and in a differential scanning calorimetric measurement of the magnetic toner, i) the peak temperature (Cm) of the highest endothermic peak originating from the crystalline polyester and obtained during a first temperature ramp up is from at least 70° C. to not more than 130° C., and ii) when ΔH1 is an amount of heat absorption calculated from the area, which is bounded by a differential scanning calorimetric curve "a" that displays the highest endothermic peak originating from the crystalline polyester and obtained during the first temperature ramp up, and the baseline of the differential scanning calorimetric curve "a", and ΔH2 is an amount of heat absorption calculated from the area, which is bounded by a differential scanning calorimetric curve that displays the highest endothermic peak originating from the crystalline polyester and obtained during a second temperature ramp up, and the baseline of the differential scanning calorimetric curve "b", the value obtained by subtracting ΔH2 from ΔH1 is from at least 0.30 J/g to not more than 5.30 J/g.

Advantageous Effects of Invention

The present invention can provide a magnetic toner that exhibits an excellent electrostatic offset resistance both initially and also after long-term use.

DESCRIPTION OF EMBODIMENTS

Figure 1:
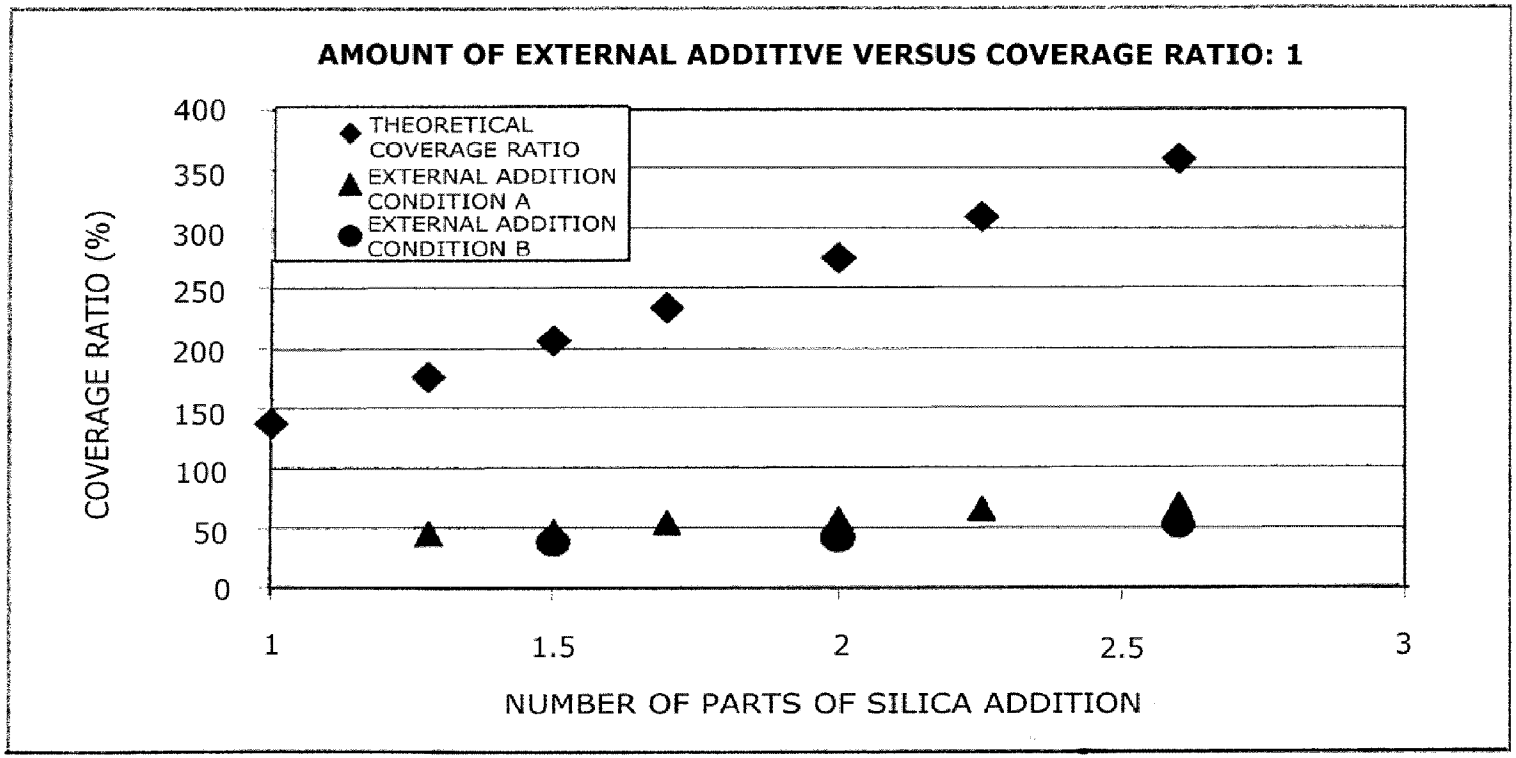
FIG. 1 is a diagram that shows an example of the relationship between the number of parts of silica addition and the coverage ratio.

The present invention relates to a magnetic toner. Heretofore known electrophotographic processes can be used for the image-forming method and the fixing method and there are no particular limitations thereon.

The magnetic toner (also referred to simply as toner in the following) of the present invention is a magnetic toner comprising magnetic toner particles comprising a binder resin and a magnetic body, and inorganic fine particles present on the surface of the magnetic toner particles, wherein;

the inorganic fine particles present on the surface of the magnetic toner particles comprise metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein;

when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the magnetic toner has a coverage ratio A of at least 45.0% and not more than 70.0% and a ratio [coverage ratio B/coverage ratio A] of the coverage ratio B to the coverage ratio A of from at least 0.50 to not more than 0.85;

the magnetic toner particle contains a crystalline polyester; and in a differential scanning calorimetric measurement of the magnetic toner, i) the peak temperature (Cm) of the highest endothermic peak originating from the crystalline polyester and obtained during a first temperature ramp up is from at least 70° C. to not more than 130° C., and ii) when ΔH1 is the amount of heat absorption calculated from the area bounded by a differential scanning calorimetric curve "a" that displays the highest endothermic peak originating from the crystalline polyester and obtained during the first temperature ramp up, and the baseline of the differential scanning calorimetric curve "a", and ΔH2 is the amount of heat absorption calculated from the area bounded by a differential scanning calorimetric curve "b" that displays the highest endothermic peak originating from the crystalline polyester and obtained during a second temperature ramp up, and the baseline of the differential scanning calorimetric curve "b", the value obtained by subtracting ΔH2 from ΔH1 is from at least 0.30 J/g to not more than 5.30 J/g.

The mechanism underlying the occurrence of electrostatic offset will be described first.

Electrostatic offset is caused when the toner on the paper undergoes random electrostatic flight onto the fixing member in the stage prior to the introduction of the paper loaded with unfixed toner into the nip between the fixing member and the pressure roller. The driving force for toner flight at this point is thought to be primarily an electrostatic force. The toner that has flown onto the fixing member produces random image defects through its introduction as such into the fixing nip where it is fixed on the paper and through its contamination of the fixing member. This is the phenomenon known as static offset.

The toner that randomly flies onto the fixing member upstream from the fixing nip is mainly toner bearing an opposite charge from normal, and this oppositely charged toner component is generally called a charge inversion component. Production of the charge inversion component occurs more readily as the toner charge distribution becomes broader. Due to this, reducing the inversion component by sharpening the toner charge distribution was pursued as an approach for improving the electrostatic offset.

However, even if the toner charge distribution at between the developing sleeve and developing blade, where charge is imparted to the toner, or on the developing drum is sharpened, an inversion component ends up being produced to some extent in the toner during passage through the transfer step, where the electrostatic flight of the toner onto the paper is brought about. As a consequence, an approach based on improving the charge distribution was considered to be unsatisfactory as a fundamental solution to electrostatic offset.

In a separate approach, a procedure was therefore considered in which flight of the oppositely charged toner is inhibited by bringing about a semi-melting and hence a coalescence of the toner on the unfixed image in the vicinity of the fixing unit. In actuality, numerous toners exist that contain a crystalline polyester that rapidly melts in response to heating. However, none of these have achieved a satisfactory coalescence of the toner on the unfixed image and they have not been a satisfactory countermeasure to electrostatic offset. However, additional increments in the amount of a simple crystalline polyester end up producing various problems, e.g., due to an increase in the hygroscopicity, a reduction in the charging performance of the toner and a deterioration in the environmental stability of the toner. In addition, when—even in a technique other than the use of a crystalline polyester—the toner readily undergoes excessive melting in response to heating, this is a factor that causes problems such as a deterioration in the storability, a deterioration in the hot offset, and a reduction in the image density.

The present inventors therefore carried out focused investigations in order to improve the electrostatic offset by a technique other than those considered above. As a result, it was discovered that the problem identified above can be solved by controlling the state of external addition of the inorganic fine particles to the magnetic toner particle and raising the density of the loading configuration of the magnetic toner on the paper and by incorporating within the magnetic toner a prescribed amount of a component that rapidly outmigrates in response to heating. The details are given in the following.

A summary of the magnetic toner of the present invention is as follows. First, for the magnetic toner of the present invention the state of coverage of the magnetic toner particle surface by the inorganic fine particles and the state of coverage by the inorganic fine particles that are fixed to the magnetic toner particle surface are optimized and the density of the magnetic toner in the unfixed image on the paper is increased. In addition, it is thought that the incorporation of a crystalline polyester in the magnetic toner particles of the magnetic toner of the present invention and its rapid outmigration serve to promote a rapid coalescence or unification of the magnetic toner on the paper, which inhibits flight of the inversion component and thus reduces the occurrence of electrostatic offset.

The views of the present inventors on the detailed mechanisms underlying the improvement in electrostatic offset are as follows.

First, it is thought that the magnetic toner of the present invention is loaded on the media, e.g., paper, in a state approximating closest packing. Here, due, for example, to the formation of a shell layer by the inorganic fine particles due to the optimization of the coverage ratio by the inorganic fine particles that are fixed to the magnetic toner particle surface, the van der Waals force is readily reduced and the magnetic toner-to-magnetic toner attachment force is then reduced. In addition, it is thought that the weakly attached inorganic fine particles exercise a bearing effect between magnetic toner particles and that the magnetic toner-to-magnetic toner adherence is thereby reduced in comparison to a conventional state of external addition.

The packing of the magnetic toner prior to fixing on the paper can be brought to even higher densities when the magnetic toner-to-magnetic toner adherence is reduced and the aggregative force between the magnetic toners is then substantially reduced. The causes for this are thought to be as follows.

In development methods that use a magnetic toner, development is carried out by transporting the magnetic toner into the developing zone using a toner-carrying member that is provided in its interior with means for generating a magnetic field. In the developing zone, the magnetic toner on the developing sleeve forms magnetic chain along the lines of magnetic force in the magnetic field. At this stage, it is thought that in a magnetic toner that exhibits low aggregative forces between the magnetic toners, the magnetic toner particles form magnetic chain that are packed in a high density approximating closest packing. It is thought that, due to its high degree of freedom of motion, a magnetic toner that exhibits low aggregative forces readily assumes closest packing when the magnetic toner is attracted to the developing sleeve surface by the magnetic field of the, for example, magnet roll. Moreover, the present inventors believe that the magnetic toner can be loaded at a high density on the paper prior to fixing because very densely packed magnetic chain undergo development and are transferred to the recording medium.

Moreover, when the magnetic toner-to-magnetic toner attachment force is high, aggregates are readily formed both electrostatically and physically, in which case the density of the whole mass declines due to the large gaps that occur between aggregates, and another cause is thought to be that aggregates do not form and densest packing can then occur when the magnetic toner-to-magnetic toner attachment force is weak.

Furthermore, it is thought that the flowability of the whole mass is improved due to the low magnetic toner-to-magnetic toner attachment force and the behavior of the particles in the magnetic toner charging step is then made more uniform, and as a consequence the generation of the inversion component is also suppressed.

However, this by itself is inadequate for inhibiting flight of the inversion component and reducing electrostatic offset.

In addition to controlling the state of external addition of the inorganic fine particles on the magnetic toner particle surface in the magnetic toner of the present invention, a crystalline polyester is incorporated in the magnetic toner particle in the magnetic toner of the present invention. Crystalline polyester has the property of rapidly melting and expanding in response to heat and outmigrating to the surface of the magnetic toner particle. Due to this, it is thought that the crystalline polyester in the magnetic toner particle—upon being subjected to heat conduction in the vicinity of the fixing nip, in which vicinity the inversion component ends up taking flight in the case of a conventional toner—liquefies and outmigrates to the surface of the magnetic toner particle. It is further thought that this liquefied crystalline polyester causes magnetic toner-to-magnetic toner adhesion in the closest packed magnetic toner and thereby inhibits flight of the inversion component. It is believed that—due to the previously described state of external addition of the inorganic fine particles, which brings about closest packing within the magnetic toner and maximizes the magnetic toner-to-magnetic area of contact—the action of this crystalline polyester is for the first time raised up to a level that inhibits flight of the inversion component. In addition, the maximization of thermal conductivity between the unfixed toners brought about by closest packing is also a crucial point.

In addition, an effect can also be expected in which the liquefied and outmigrated crystalline polyester covers up charged locations on the magnetic toner surface, causing a decline in the charge of the inversion component.

The component responsible for outmigration and coalescence must be crystalline polyester in the magnetic toner of the present invention. The present inventors conjecture as follows with regard to the reasons for this.

In order to inhibit flight of the inversion component, the component responsible for outmigration and coalescence desirably induces the strongest possible magnetic toner-to-magnetic toner binding. Due to this, the outmigrating component must have a somewhat high viscosity.

Here, as factors that govern the viscosity of a liquid polymer, there are two causes, i.e., intermolecular friction and resistance due to steric hindrance-based entanglement of the polymer chains. A crystalline polyester has a relatively long molecular chain and a high density of occurrence of the polar ester group, and as a consequence when melted also exhibits high intermolecular friction and entanglement-induced resistance and thus exhibits a high viscosity. For this reason, it can be regarded as having satisfactory properties as an outmigration component.

In addition to crystalline polyesters, multifunctional ester waxes can be contemplated as a component that outmigrates during a typical heating. However, in the case of a multifunctional ester wax, interaction with other wax molecules is poor because relatively few ester groups are present and because structurally the ester groups are near the center of the molecule. Moreover, due to a structure in which the core is a central multifunctional ester with alkyl chains extending therefrom, mutual entanglement is more difficult than for a molecule having a straight-chain structure. Due to this, it is thought that securing an adequate viscosity is problematic even when melting and outmigration have occurred.

Moreover, electrostatic offset normally tends to worsen during long-term use due to a broadening of the charge distribution in the magnetic toner; however, it was shown that the magnetic toner of the present invention can maintain its properties even during long-term use.

The present inventors consider the following to be the reasons for this.

As has been previously described, the magnetic toner of the present invention contains inorganic fine particles that are fixed to the magnetic toner particle surface and inorganic fine particles that are weakly attached in its upper layer, and these uniformly cover the magnetic toner particle surface in the magnetic toner of the present invention. Due to this, the propensity for magnetic toner-to-magnetic toner attachment to occur and the propensity for magnetic toner-to-magnetic toner aggregation to occur are reduced. In addition, since the attachment force to, e.g., members of the apparatus, is also reduced, physical damage during the electrophotographic process is made less likely. Due to this, the occurrence of the deterioration in the magnetic toner caused by embedding of the external additive is suppressed. Furthermore, in comparison to a conventional state of coverage by the inorganic fine particles, inorganic fine particles fixed to the magnetic toner particle surface are present, and it is thought that as a result embedding of the weakly attached inorganic fine particles in its upper layer is suppressed and changes in the state of occurrence of the inorganic fine particles are also minimized during long-term use.

The magnetic toner of the present invention is specifically considered in the following.

Letting the coverage ratio A (%) be the coverage ratio of the magnetic toner particle surface by the inorganic fine particles and letting the coverage ratio B (%) be the coverage ratio by the inorganic fine particles that are fixed to the magnetic toner particle surface, it is critical for the magnetic toner of the present invention that the coverage ratio A be at least 45.0% and not more than 70.0% and that the ratio [coverage ratio B/coverage ratio A, also referred to below simply as B/A] of the coverage ratio B to the coverage ratio A be at least 0.50 and not more than 0.85. The coverage ratio A is preferably at least 45.0% and not more than 65.0% and B/A is preferably at least 0.55 and not more than 0.80.

Since, with the magnetic toner of the present invention, the coverage ratio A has a high value of at least 45.0%, the magnetic toner-to-magnetic toner van der Waals force and the van der Waals force for members of the apparatus are low and the magnetic toner-to-magnetic toner attachment force and the attachment force with members of the apparatus are therefore reduced, and due to this the unfixed image is loaded in a more closely packed manner on the paper and the electrostatic offset resistance is substantially improved. In addition, the electrostatic offset resistance is maintained because there is little deterioration in the magnetic toner even during long-term use.

The inorganic fine particles must be added in large amounts in order to bring the coverage ratio A above 70.0%. Even if an external addition method could be devised here, thermal conduction will be lowered by the released inorganic fine particles and rapid coalescence will be hindered and the electrostatic offset resistance will deteriorate as a result.

When, on the other hand, the coverage ratio A is less than 45.0%, from the outset the magnetic toner particle surface cannot be adequately covered by the inorganic fine particles and as a consequence the production of, e.g., aggregates, is facilitated. When an aggregate-rich magnetic toner is transferred onto paper, the packing density as a whole is reduced due to the large gaps. As a result, the coalescence function of the crystalline polyester cannot be manifested and the electrostatic offset cannot be improved. In addition, as described below, the long-term storability in a high-temperature, high-humidity environment deteriorates when a crystalline polyester in incorporated in the magnetic toner particles without specifically designing the state of external addition by the inorganic fine particles.

As noted above, the inorganic fine particles that can be present between magnetic toner particles and between the magnetic toner and the various members participate in bringing about the effect of diminished van der Waals forces and diminished electrostatic forces. It is thought that having a higher coverage ratio A is particularly critical with regard to this effect.

First, the van der Waals force (F) produced between a flat plate and a particle is represented by the following equation.

$$F=H\times D/(12Z^2)$$

Here, H is Hamaker's constant, D is the diameter of the particle, and Z is the distance between the particle and the flat plate.

With respect to Z, it is generally held that an attractive force operates at large distances and a repulsive force operates at very small distances, and Z is treated as a constant since it is unrelated to the state of the magnetic toner particle surface.

According to the preceding equation, the van der Waals force (F) is proportional to the diameter of the particle in contact with the flat plate. When this is applied to the magnetic toner surface, the van der Waals force (F) is smaller for an inorganic fine particle, with its smaller particle size, in contact with the flat plate than for a magnetic toner particle in contact with the flat plate. That is, the van der Waals force is smaller for the case of contact through the intermediary of the inorganic fine particles provided as an external additive than for the case of direct contact between the magnetic toner particles.

The coverage ratio by the inorganic fine particles can be worked out on the assumption that the inorganic fine particles and the magnetic toner have a spherical shape, in use of an equation. However, there are also many instances in which the inorganic fine particles and/or the magnetic toner do not have a spherical shape, and in addition the inorganic fine particles may also be present in an aggregated state at the toner particle surface. As a consequence, the theoretical coverage ratio derived using the indicated technique does not pertain to the present invention.

The present inventors therefore carried out observation of the magnetic toner surface with the scanning electron microscope (SEM) and determined the coverage ratio for the actual coverage of the magnetic toner particle surface by the inorganic fine particles.

Figure 2:
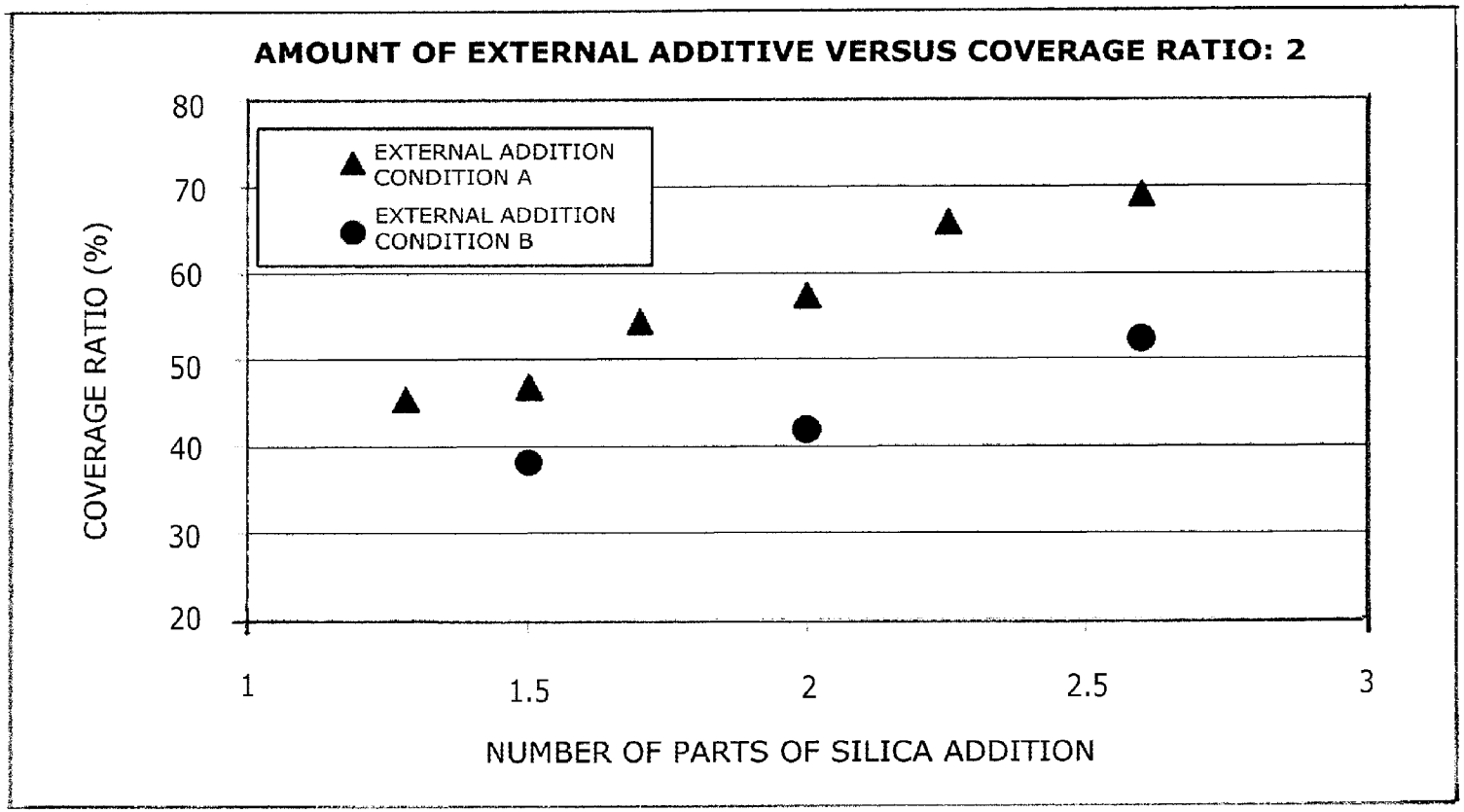
FIG. 2 is a diagram that shows an example of the relationship between the number of parts of silica addition and the coverage ratio.

As one example, the theoretical coverage ratio and the actual coverage ratio were determined for mixtures prepared by adding different amounts of silica fine particles (number of parts of silica addition to 100 mass parts of magnetic toner particles) to magnetic toner particles (magnetic body content=43.5 mass %) provided by a pulverization method and having a volume-average particle diameter (Dv) of 8.0 μm (refer to FIGS. 1 and 2). Silica fine particles with a volume-average particle diameter (Dv) of 15 nm were used for the silica fine particles. For the calculation of the theoretical coverage ratio, 2.2 g/cm$^3$ was used for the true specific gravity of the silica fine particles; 1.65 g/cm$^3$ was used for the true specific gravity of the magnetic toner; and monodisperse particles with a particle diameter of 15 nm and 8.0 μm were assumed for, respectively, the silica fine particles and the magnetic toner particles.

As shown in FIG. 1, the theoretical coverage ratio exceeds 100% as the amount of addition of the silica fine particles is increased. On the other hand, the actual coverage ratio does vary with the amount of addition of the silica fine particles, but does not exceed 100%. This is due to silica fine particles being present to some degree as aggregates on the magnetic toner surface or is due to a large effect from the silica fine particles not being spherical.

Moreover, according to investigations by the present inventors, it was found that, even at the same amount of addition by the silica fine particles, the coverage ratio varied also with the external addition technique. That is, it is not possible to determine the coverage ratio uniquely from the amount of addition of the silica fine particles (refer to FIG. 2). Here, external addition condition A refers to mixing at 1.0 W/g for a processing time of 5 minutes using the apparatus shown in FIG. 5. External addition condition B refers to mixing at 4000 rpm for a processing time of 2 minutes using an FM10C Henschel mixer (from Mitsui Miike Chemical Engineering Machinery Co., Ltd.).

For the reasons provided in the preceding, the present inventors used the inorganic fine particle coverage ratio obtained by SEM observation of the magnetic toner surface.

As described above, it is thought that the attachment force to a member can be reduced by raising the coverage ratio by the inorganic fine particles. Tests were therefore carried out on the attachment force with a member and the coverage ratio by the inorganic fine particles.

The relationship between the coverage ratio for the magnetic toner and the attachment force with a member was indirectly inferred by measuring the static friction coefficient between an aluminum substrate and spherical polystyrene particles having different coverage ratios by silica fine particles.

Specifically, the relationship between the coverage ratio and the static friction coefficient was determined using spherical polystyrene particles (weight-average particle diameter (D4)=7.5 μm) that had different coverage ratios (coverage ratio determined by SEM observation) by silica fine particles.

Figure 3:
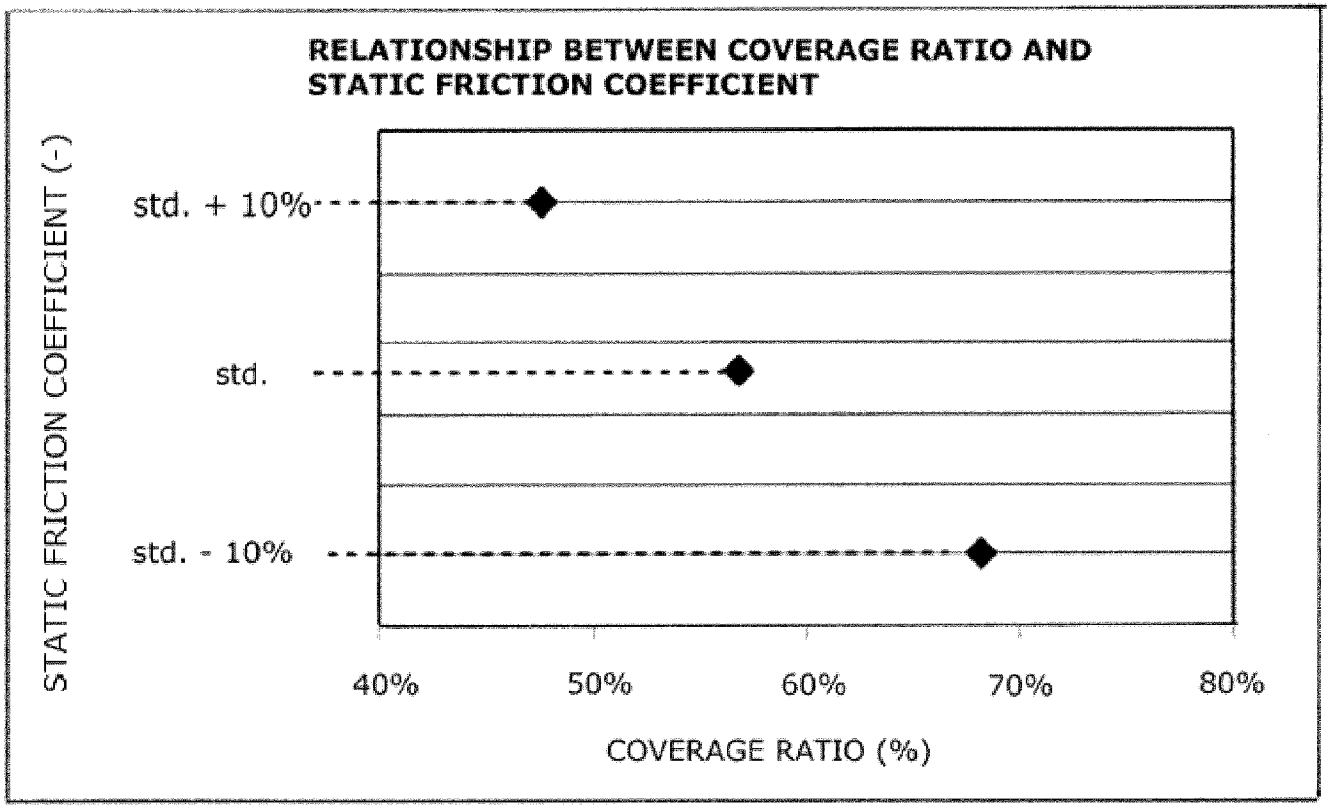
FIG. 3 is a diagram that shows an example of the relationship between the external additive coverage ratio and the static friction coefficient.

More specifically, spherical polystyrene particles to which silica fine particles had been added were pressed onto an aluminum substrate. The substrate was moved to the left and right while changing the pressing pressure, and the static friction coefficient was calculated from the resulting stress. This was performed for the spherical polystyrene particles at each different coverage ratio, and the obtained relationship between the coverage ratio and the static friction coefficient is shown in FIG. 3.

The static friction coefficient determined by the preceding technique is thought to correlate with the sum of the van der Waals and reflection forces acting between the spherical polystyrene particles and the substrate. As shown in FIG. 3, a higher coverage ratio by the silica fine particles tends to result in a lower static friction coefficient. This suggests that a magnetic toner that presents a high coverage ratio by inorganic fine particles also has a low attachment force for members.

B/A will now be considered. The coverage ratio A is a coverage ratio that also includes the easily releasable inorganic fine particles, while the coverage ratio B is the coverage ratio due to inorganic fine particles that are fixed to the magnetic toner particle surface and are not released in the release process described below. It is thought that the inorganic fine particles represented by the coverage ratio B are fixed in a semi-embedded state in the magnetic toner particle surface and therefore do not undergo displacement even when the magnetic toner is subjected to shear on the developing sleeve or on the electrostatic latent image-bearing member. The inorganic fine particles represented by the coverage ratio A contain the inorganic fine particles that are fixed to the magnetic toner particle surface and, over an upper layer thereof, inorganic fine particles exhibiting a higher degree of freedom.

That B/A is in the range from at least 0.50 to not more than 0.85 indicates that inorganic fine particles fixed to the magnetic toner particle surface are present to a certain degree and that at the same time weakly attached inorganic fine particles are also present in its upper layer in a favorable amount. It is thought that with such a state of external addition, the weakly attached, easily releasable inorganic fine particles exhibit a bearing-like action that lowers the friction with respect to the magnetic toner particle surface in which inorganic fine particles are fixed, and that the magnetic toner-to-magnetic toner attachment behavior is substantially attenuated.

The attenuation of the magnetic toner-to-magnetic toner attachment behavior makes it possible, as previously described, for the packing of the unfixed toner on the paper to more nearly approach closest packing, and the thermal conductivity is then also improved. As a result, this brings about a thorough generation of the crystalline polyester-based coalescence function in the magnetic toner and can bring about a reduction in electrostatic offset. Furthermore, due to an improved flowability brought about by the lowering of the magnetic toner-to-magnetic toner attachment force, the state of tribocharging approaches uniformity and the inversion component is then reduced, which again contributes to improving the electrostatic offset.

On the other hand, it is thought that the physical stresses on the magnetic toner during long-term use are relaxed by the bearing effect and that this electrostatic offset-improving effect is maintained throughout high output levels.

The coefficient of variation on the coverage ratio A is preferably not more than 10.0% in the present invention. Not more than 8.0% is more preferred. The specification of a coefficient of variation on the coverage ratio A of not more than 10.0% means that the coverage ratio A is very uniform between magnetic toner particles and within magnetic toner particles. When the coefficient of variation on the coverage ratio A is not more than 10.0%, this is preferred because the state of coverage by the inorganic fine particles on the magnetic toner particles then approaches uniformity within the system and local regions with a high coverage ratio by the inorganic fine particles, which hinder magnetic toner-to-magnetic toner melt bonding, are reduced and there is no unevenness in the coalescence induced by the outmigrated crystalline polyester.

When the coefficient of variation on the coverage ratio A exceeds 10.0%, the differences from region to region in the state of coverage of the magnetic toner particle surface by the inorganic fine particles is then relatively large, which impairs the ability to lower the aggregative forces between the magnetic toners.

The use is preferred of the external addition apparatus and technique described below—which are capable of bringing about a high degree of spreading of the silica fine particles over the magnetic toner particle surface—to bring the coefficient of variation on the coverage ratio A to 10.0% or below.

According to the results of investigations by the present inventors, it was found that this bearing effect and the above-described attachment force-reducing effect are maximally obtained when both the inorganic fine particles that are fixed to the magnetic toner particle surface and the easily releasable inorganic fine particles are relatively small inorganic fine particles having a primary particle number-average particle diameter (D1) of approximately at least 5 nm but not more than 50 nm. Accordingly, the coverage ratio A and the coverage ratio B were calculated focusing on the inorganic fine particles having a diameter of not more than 50 nm.

It is crucial for the magnetic toner of the present invention that the magnetic toner particle contains a crystalline polyester; that the peak temperature (Cm), as measured on the magnetic toner using a differential scanning calorimeter (DSC), of the highest endothermic peak originating from the crystalline polyester and obtained during a first temperature ramp up is from at least 70° C. to not more than 130° C.; and that—letting ΔH1 be the amount of heat absorption calculated from the area bounded by a differential scanning calorimetric curve "a" that displays the highest endothermic peak originating from the crystalline polyester and obtained during the first temperature ramp up, and the baseline of the differential scanning calorimetric curve "a", and letting ΔH2 be the amount of heat absorption calculated from the area bounded by a differential scanning calorimetric curve "b" that displays the highest endothermic peak originating from the crystalline polyester and obtained during a second temperature ramp up, and the baseline of the differential scanning calorimetric curve "b"—the value obtained by subtracting ΔH2 from ΔH1 is from at least 0.30 J/g to not more than 5.30 J/g (that is, it is crucial that ΔH2 is from at least 0.30 J/g to not more than 5.30 J/g smaller than ΔH1).

When the peak temperature (Cm) for the magnetic toner of the highest endothermic peak originating from the crystalline polyester is from at least 70° C. to not more than 130° C., a rapid coalescence of the unfixed image is then made possible while maintaining the storage stability. When, on the other hand, Cm is less than 70° C., the storage stability, e.g., the blocking behavior, deteriorates. In addition, a resin that has a low Cm will have a relatively low molecular weight and an adequate viscosity cannot then be expected even when liquefaction and outmigration to the magnetic toner surface occur, and as a consequence inhibition of flight by the inversion component is impaired. When Cm is larger than 130° C., the pulverizability deteriorates and the particle diameter distribution of the magnetic toner particles broadens. In addition, a resin that has a high Cm will tend to have a large molecular weight, which impedes rapid outmigration to the magnetic toner surface upon melting.

Here, in order to ensure that the peak measured for the magnetic toner by DSC originates with the crystalline polyester, the crystalline component is first isolated as the residue by Soxhlet extraction of the magnetic toner using methyl ethyl ketone (MEK) solvent. In addition, whether the molecular structure of this extraction residue is the crystalline polyester component is checked by measurement of the NMR spectrum; this is followed by DSC measurement of the extraction residue simple substance and assessment by comparing this peak with the peak from DSC measurement of the magnetic toner.

With regard to the highest endothermic peak measured for the magnetic toner by DSC, an endothermic peak in DSC measurement inherently originates with a crystalline structure. Thus, ΔH1 indicates the existence of the crystalline structure of the crystalline polyester in the magnetic toner. The endothermic peak originating with this crystalline structure is extinguished in the second temperature ramp up because the crystalline polyester melts during the first temperature ramp up and miscibilizes with the surrounding non-crystalline resin and the crystalline structure is then lost. Due to this, the amount of the crystalline structure originating from the crystalline polyester can be established from the amount of decline from ΔH1 to ΔH2 (that is, ΔH1−ΔH2).

When the amount of heat absorption for the crystalline structure originating with the crystalline polyester is at least 0.30 J/g and not more than 5.30 J/g in the magnetic toner, rapid melting and outmigration to the magnetic toner surface occur during heat conduction and a coalescing action on clusters of unfixed toner is produced. When [ΔH1−ΔH2] is less than 0.30 J/g, there is too little crystalline structure and an adequate outmigration of the crystalline polyester cannot be expected. When, on the other hand, [ΔH1−ΔH2] is larger than 5.30 J/g, too much crystalline polyester is present and as a consequence the hygroscopicity of the magnetic toner deteriorates and, for example, charging defects are produced due to charge leakage.

Moreover, Cm is preferably from at least 90° C. to not more than 125° C. and [ΔH1−ΔH2] is preferably from at least 0.5 J/g to not more than 3.0 J/g.

Cm can be adjusted into the indicated range by judicious adjustment of the types of monomer constituting the crystalline polyester and their constituent ratios. On the other hand, [ΔH1−ΔH2] can be adjusted into the indicated range, for example, by adjusting the ratio of the crystalline structure by controlling the cooling rate in the toner resin kneading step.

The magnetic toner of the present invention preferably contains a release agent. The release agent content, expressed per 100 mass parts of the binder resin, is preferably from at least 1 mass part to not more than 10 mass parts. In addition, the peak temperature (Wm) of the highest endothermic peak originating with the release agent and measured on the magnetic toner using a differential scanning calorimeter (DSC) is preferably at least 40° C., and Wm and the previously described peak temperature (Cm) of the highest endothermic peak originating with the crystalline polyester and obtained during the first temperature ramp up in measurement of the magnetic toner using a differential scanning calorimeter (DSC) preferably satisfy the following formula (1).

$$35 \leq Cm - Wm \leq 55 \quad \text{formula 1:}$$

The release agent in a magnetic toner has heretofore been expected to improve the low-temperature fixability by exhibiting a plasticizing effect on the binder resin and at the same time to prevent attachment of the magnetic toner to members of the apparatus, e.g., the fixing roller, by outmigrating to the magnetic toner surface during fixing.

A release agent content in the present invention, expressed per 100 mass parts of the binder resin, of from at least 1 mass part to not more than 10 mass parts and a [Cm−Wm] from at least 35° C. to not more than 55° C. are preferred because the release agent then melts before the crystalline polyester and facilitates the outmigration of the crystalline polyester by plasticizing the binder resin. These are also preferred in order to assist the coalescing action on clusters of unfixed toner brought about by outmigration of the crystalline polyester.

In addition, the peak temperature (Wm) of the highest endothermic peak originating with this release agent is preferably at least 40° C. in order to obtain a satisfactory storage stability for the magnetic toner.

The binder resin in the magnetic toner in the present invention can be, for example, a vinyl resin or a polyester resin, but is not particularly limited and the heretofore known resins can be used.

Specific examples of a vinyl resin include polystyrene or a styrene copolymer, e.g., a styrene-propylene copolymer, styrene-vinyltoluene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-butadiene copolymer, styrene-isoprene copolymer, styrene-maleic acid copolymer, or styrene-maleate ester copolymer; as well as a polyacrylate ester; polymethacrylate ester; polyvinyl acetate; and so forth, and a single one of these may be used or a combination of a plurality of these may be used.

The polyester resin is as follows.

As a monomer forming a polyester resin, the following can be utilized.

First, the divalent alcohol component constituting the polyester resin can be exemplified by ethylene glycol, propylene glycol, butanediol, diethylene glycol, triethylene glycol, pentanediol, hexanediol, neopentyl glycol, hydrogenated bisphenol A, bisphenols with the following formula (A) and their derivatives, and diols with the following formula (B).

[C1]

(A)

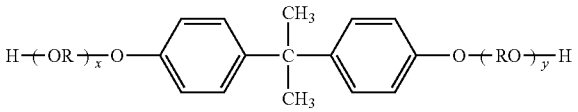

(In the formula, R is an ethylene group or propylene group; x and y are each integers greater than or equal to 0; and the average value of x+y is greater than or equal to 0 and less than or equal to 10.)

[C2]

(B)

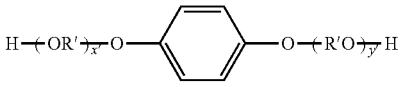

(In the formula, R' is —$CH_2CH_2$— or —$CH_2CH(CH_3)$— or —$CH_2$— $C(CH_3)_2$—; x' and y' are integers greater than or equal to 0; and the average value of x+y is greater than or equal to 0 and less than or equal to 10.)

Second, the divalent acid component constituting the polyester resin can be exemplified by benzenedicarboxylic acids such as phthalic acid, terephthalic acid, isophthalic acid, and phthalic anhydride; alkyldicarboxylic acids such as succinic acid, adipic acid, sebacic acid, and azelaic acid; alkenylsuccinic acids such as n-dodecenylsuccinic acid; and unsaturated dicarboxylic acids such as fumaric acid, maleic acid, citraconic acid, and itaconic acid.

A trivalent or higher valent alcohol component by itself or a trivalent or higher valent acid component by itself may be used as a crosslinking component, or both may be used in combination.

The trivalent or higher valent polyvalent alcohol component can be exemplified by sorbitol, pentaerythritol, dipentaerythritol, tripentaerythritol, butanetriol, pentanetriol, glycerol, methylpropanetriol, trimethylolethane, trimethylolpropane, and trihydroxybenzene.

The trivalent or higher valent polyvalent carboxylic acid component in the present invention can be exemplified by trimellitic acid, pyromellitic acid, benzenetricarboxylic acid, butanetricarboxylic acid, hexanetricarboxylic acid, and tetracarboxylic acids with the following formula (C).

[C3]

(C)

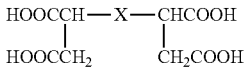

(X in the formula represents a $C_{5-30}$ alkylene group or alkenylene group that has at least one side chain that contains at least three carbons.)

This polyester resin is ordinarily obtained by a generally known condensation polymerization reaction.

Styrene copolymers and polyester resins are particularly preferred among the preceding for the binder resin of the magnetic toner from the standpoint of, e.g., the developing characteristics and the fixing performance.

The crystalline polyester present in the magnetic toner particle in the magnetic toner of the present invention is obtained by the polycondensation reaction of a monomer composition that contains, as its main components, $C_{2-22}$ aliphatic diol and $C_{2-22}$ aliphatic dicarboxylic acid.

While there are no particular limitations on the $C_{2-22}$ (more preferably $C_{2-12}$) aliphatic diol, chain (preferably straight-chain) aliphatic diols are preferred, for example, ethylene glycol, diethylene glycol, triethylene glycol, 1,2-propylene glycol, 1,3-propylene glycol, dipropylene glycol, 1,4-butanediol, 1,4-butadiene glycol, trimethylene glycol, tetramethylene glycol, pentamethylene glycol, hexamethylene glycol, octamethylene glycol, nonamethylene glycol, decamethylene glycol, and neopentyl glycol. Particularly preferred examples among the preceding are straight-chain aliphatic α,ω-diols, e.g., ethylene glycol, diethylene glycol, 1,4-butanediol, and 1,6-hexanediol.

Preferably at least 50 mass % and more preferably at least 70 mass % of the alcohol component is an alcohol selected from the $C_{2-22}$ aliphatic diols.

A polyvalent alcohol monomer can also be used in the present invention in addition to the aforementioned aliphatic diol. The divalent alcohol monomers among these polyvalent alcohol monomers can be exemplified by aromatic alcohols such as polyoxyethylenated bisphenol A and polyoxypropylenated bisphenol A and by 1,4-cyclohexanedimethanol. The trivalent or higher valent polyvalent alcohol monomers among these polyvalent alcohol monomers can be exemplified by aromatic alcohols such as 1,3,5-trihydroxymethylbenzene and by aliphatic alcohols such as pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, and trimethylolpropane.

A monovalent alcohol may also be used in the present invention insofar as the characteristics of the crystalline polyester are not impaired. This monovalent alcohol can be exemplified by monofunctional alcohols such as n-butanol, isobutanol, sec-butanol, n-hexanol, n-octanol, lauryl alcohol, 2-ethylhexanol, decanol, cyclohexanol, benzyl alcohol, and dodecyl alcohol.

On the other hand, while there are no particular limitations on the $C_{2-22}$ (more preferably $C_{4-14}$) aliphatic dicarboxylic acid, chain (preferably straight-chain) aliphatic dicarboxylic acids are preferred. Specific examples are oxalic acid, malonic acid, succinic acid, glutaric acid, adipic acid, pimelic acid, suberic acid, glutaconic acid, azelaic acid, sebacic acid, nonanedicarboxylic acid, decanedicarboxylic acid, undecanedicarboxylic acid, dodecanedicarboxylic acid, maleic acid, fumaric acid, mesaconic acid, citraconic acid, and itaconic acid, including also, for example, their anhydrides and the hydrolyzates of their lower alkyl esters.

In the present invention, preferably at least 50 mass % and more preferably at least 70 mass % of this carboxylic acid component is a carboxylic acid selected from the $C_{2-22}$ aliphatic dicarboxylic acids.

A polyvalent carboxylic acid other than the aforementioned $C_{2-22}$ aliphatic dicarboxylic acid can also be used in the present invention. The divalent carboxylic acids among the other polyvalent carboxylic acid monomers can be exemplified by aromatic carboxylic acids such as isophthalic acid and terephthalic acid; aliphatic carboxylic acids such as n-dodecylsuccinic acid and n-dodecenylsuccinic acid; and alicyclic carboxylic acids such as cyclohexanedicarboxylic acid, including also, for example, their anhydrides and lower alkyl esters. In addition, the trivalent or higher valent polyvalent carboxylic acids among the other carboxylic acid monomers can be exemplified by aromatic carboxylic acids such as 1,2,4-benzenetricarboxylic acid (trimellitic acid), 2,5,7-naphthalenetricarboxylic acid, 1,2,4-naphthalenetricarboxylic acid, and pyromellitic acid and by aliphatic carboxylic acids such as 1,2,4-butanetricarboxylic acid, 1,2,5-hexanetricarboxylic acid, and 1,3-dicarboxyl-2-methyl-2-methylenecarboxypropane, including also their derivatives such as anhydrides and lower alkyl esters.

A monovalent carboxylic acid may also be incorporated in the present invention to the extent that the characteristics of the crystalline polyester are not impaired. This monovalent carboxylic acid can be exemplified by monocarboxylic acids such as benzoic acid, naphthalenecarboxylic acid, salicylic acid, 4-methylbenzoic acid, 3-methylbenzoic acid, phenoxyacetic acid, biphenylcarboxylic acid, acetic acid, propionic acid, butyric acid, octanoic acid, decanoic acid, dodecanoic acid, and stearic acid.

The crystalline polyester for the present invention can be produced according to ordinary polyester synthesis methods. For example, the desired crystalline polyester can be obtained by carrying out an esterification reaction or an ester exchange reaction between the above-described carboxylic acid monomer and alcohol monomer and thereafter carrying out a polycondensation reaction according to an ordinary method under reduced pressure or with the introduction of nitrogen gas.

As necessary, this esterification or ester exchange reaction can be run using an ordinary esterification catalyst or ester exchange catalyst, for example, sulfuric acid, titanium butoxide, dibutyltin oxide, manganese acetate, magnesium acetate, and so forth.

This polycondensation reaction can be run using an ordinary polymerization catalyst, for example, a known catalyst such as titanium butoxide, dibutyltin oxide, tin acetate, zinc acetate, tin disulfide, antimony trioxide, germanium dioxide, and so forth. The polymerization temperature and amount of catalyst may be determined as appropriate without particular limitation.

In the esterification reaction or ester exchange reaction or polycondensation reaction, for example, a method may be used in which the entire monomer is charged all together in order to raise the strength of the obtained crystalline polyester, or, in order to reduce the low molecular weight component, the divalent monomer may be reacted first followed by the addition and reaction of the trivalent or higher valent monomer.

As the release agent in the present invention, a hydrocarbon wax, e.g., low molecular polyethylene, low molecular weight polypropylene, microcrystalline wax, paraffin wax, and so forth, is preferred due to the corresponding ease of dispersion in the magnetic toner. As necessary, a single one of these may be used or two or more may be used in combination.

Specific examples of the release agent can be exemplified such as petroleum waxes, e.g., paraffin wax, microcrystalline wax, and petrolatum, and their derivatives; montan waxes and their derivatives; hydrocarbon waxes provided by the Fischer-Tropsch method and their derivatives; polyolefin waxes, as typified by polyethylene and polypropylene, and their derivatives; natural waxes, e.g., carnauba wax and candelilla wax, and their derivatives; and ester waxes. Here, the derivatives include oxidized products, block copolymers with vinyl monomers, and graft modifications. In addition, the ester wax can be a monofunctional ester wax or a multifunctional ester wax, e.g., most prominently a difunctional ester wax but also a tetrafunctional or hexafunctional ester wax.

The release agent can be incorporated in the binder resin by, for example, a method in which, during resin production, the resin is dissolved in a solvent, the temperature of the resin solution is raised, and addition and mixing are carried out while stirring, or a method in which addition is carried out during melt kneading during production of the toner.

The magnetic body present in the magnetic toner in the present invention can be exemplified by iron oxides such as magnetite, maghemite, ferrite, and so forth; metals such as iron, cobalt, and nickel; and alloys and mixtures of these metals with metals such as aluminum, copper, magnesium, tin, zinc, beryllium, calcium, manganese, selenium, titanium, tungsten, and vanadium.

The number-average particle diameter (D1) of the primary particles of the above magnetic bodies is preferably not more than 0.50 μm and more preferably is from 0.05 μm to 0.30 μm.

With regard to the magnetic characteristics for the application of 795.8 kA/m, the coercive force (Hc) is preferably from 1.6 to 12.0 kA/m; the intensity of magnetization (σs) is preferably from 50 to 200 $\mu m^2/kg$ and more preferably is from 50 to 100 $\mu m^2/kg$; and the residual magnetization (σr) is preferably from 2 to 20 $\mu m^2/kg$.

The content of the magnetic body in the magnetic toner of the present invention is preferably from at least 35 mass % to not more than 50 mass % and more preferably is from at least 40 mass % to not more than 50 mass %.

When the magnetic body content is less than 35 mass %, there is a reduced magnetic attraction to the magnet roll in the developing sleeve and fogging tends to readily occur. When, on the other hand, the content of the magnetic body exceeds 50 mass % is exceeded, the developing performance tends to decline while image density may be declined.

The content of the magnetic body in the magnetic toner can be measured using such as a TGA Q5000IR thermal analyzer from PerkinElmer Inc. With regard to the measurement method, the magnetic toner is heated from normal temperature to 900° C. under a nitrogen atmosphere at a rate of temperature rise of 25° C./minute: the mass loss from 100 to 750° C. is taken to be the component provided by subtracting the magnetic body from the magnetic toner and the residual mass is taken to be the amount of the magnetic body.

A charge control agent is preferably added to and used in the magnetic toner of the present invention. The magnetic toner of the present invention is preferably a negative-charging toner.

Organometal complex compounds and chelate compounds are effective as charging agents for negative charging and can be exemplified by monoazo-metal complex compounds; acetylacetone-metal complex compounds; and metal complex compounds of aromatic hydroxycarboxylic acids and aromatic dicarboxylic acids.

Specific examples of commercially available products are Spilon Black TRH, T-77, and T-95 (Hodogaya Chemical Co., Ltd.) and BONTRON (registered trademark) S-34, S-44, S-54, E-84, E-88, and E-89 (Orient Chemical Industries Co., Ltd.).

A single one of these charge control agents may be used or two or more may be used in combination. Considered from the standpoint of the amount of charging of the magnetic toner, these charge control agents are used, expressed per 100 mass parts of the binder resin, preferably at from 0.1 to 10.0 mass parts and more preferably at from 0.1 to 5.0 mass parts.

The glass-transition temperature (Tg) of the magnetic toner of the present invention is preferably from at least 40° C. to not more than 70° C. The glass-transition temperature is preferably from at least 40° C. to not more than 70° C. because this can improve the storage stability and durability while maintaining an excellent fixing performance.

The magnetic toner of the present invention contains inorganic fine particles at the magnetic toner particle surface.

The inorganic fine particles present on the magnetic toner particle surface can be exemplified by silica fine particles, titania fine particles, and alumina fine particles, and these inorganic fine particles can also be favorably used after the execution of a hydrophobic treatment on the surface thereof.

It is critical that the inorganic fine particles present on the surface of the magnetic toner particles in the present invention contain at least one type of metal oxide fine particle selected from the group consisting of silica fine particles, titania fine particles, and alumina fine particles, and that at least 85 mass % of the metal oxide fine particles be silica fine particles. Preferably at least 90 mass % of the metal oxide fine particles are silica fine particles.

The reasons for this are that silica fine particles not only provide the best balance with regard to imparting charging performance and flowability, but are also excellent from the standpoint of lowering the aggregative forces between the magnetic toners.

The reason why silica fine particles are excellent from the standpoint of lowering the aggregative forces between the magnetic toners are not entirely clear, but it is hypothesized that this is probably due to the substantial operation of the previously described bearing effect with regard to the sliding behavior between the silica fine particles.

In addition, silica fine particles are preferably the main component of the inorganic fine particles fixed to the magnetic toner particle surface. Specifically, the inorganic fine particles fixed to the magnetic toner particle surface preferably contain at least one type of metal oxide fine particle selected from the group consisting of silica fine particles, titania fine particles, and alumina fine particles wherein silica fine particles are at least 80 mass % of these metal oxide fine particles. The silica fine particles are more preferably at least 90 mass %. This is hypothesized to be for the same reasons as discussed above: silica fine particles are the best from the standpoint of imparting charging performance and flowability, and as a consequence a rapid initial rise in magnetic toner charge occurs. The result is that a high image density can be obtained, which is strongly preferred.

Here, the timing and amount of addition of the inorganic fine particles may be adjusted in order to bring the silica fine particles to at least 85 mass % of the metal oxide fine particles present on the magnetic toner particle surface and in order to also bring the silica fine particles to at least 80 mass % with reference to the metal oxide particles fixed on the magnetic toner particle surface.

The amount of inorganic fine particles present can be checked using the methods described below for quantitating the inorganic fine particles.

As described above, the number-average particle diameter (D1) of the primary particles in the inorganic fine particles in the present invention is preferably from at least 5 nm to not more than 50 nm. Bringing the number-average particle diameter (D1) of the primary particles in the inorganic fine particles into the indicated range facilitates favorable control of the coverage ratio A and B/A. When the primary particle number-average particle diameter (D1) is less than 5 nm, the inorganic fine particles tend to aggregate with one another and obtaining a large value for B/A becomes problematic and the coefficient of variation on the coverage ratio A is also prone to assume large values. When, on the other hand, the primary particle number-average particle diameter (D1) exceeds 50 nm, the coverage ratio A is prone to be small even at large amounts of addition of the inorganic fine particles; in addition, B/A will also tend to have a low value because it becomes difficult for the inorganic fine particles to become fixed to the magnetic toner particles. That is, it is difficult to obtain the above-described attachment force-reducing effect and bearing effect when the primary particle number-average particle diameter (D1) is greater than 50 nm. The number-average particle diameter (D1) of the primary particles of the inorganic fine particles is more preferably from at least 10 nm to not more than 35 nm.

A hydrophobic treatment is preferably carried out on the inorganic fine particles used in the present invention, and particularly preferred inorganic fine particles will have been hydrophobically treated to a hydrophobicity, as measured by the methanol titration test, of at least 40% and more preferably at least 50%.

The method for carrying out the hydrophobic treatment can be exemplified by methods in which treatment is carried out with, e.g., an organosilicon compound, a silicone oil, a long-chain fatty acid, and so forth.

The organosilicon compound can be exemplified by hexamethyldisilazane, trimethylsilane, trimethylethoxysilane, isobutyltrimethoxysilane, trimethylchlorosilane, dimethyldichlorosilane, methyltrichlorosilane, dimethylethoxysilane, dimethyldimethoxysilane, diphenyldiethoxysilane, and hexamethyldisiloxane. A single one of these can be used or a mixture of two or more can be used.

The silicone oil can be exemplified by dimethylsilicone oil, methylphenylsilicone oil, α-methylstyrene-modified silicone oil, chlorophenyl silicone oil, and fluorine-modified silicone oil.

A $C_{10-22}$ fatty acid is suitably used for the long-chain fatty acid, and the long-chain fatty acid may be a straight-chain fatty acid or a branched fatty acid. A saturated fatty acid or an unsaturated fatty acid may be used.

Among the preceding, $C_{10-22}$ straight-chain saturated fatty acids are highly preferred because they readily provide a uniform treatment of the surface of the inorganic fine particles.

These straight-chain saturated fatty acids can be exemplified by capric acid, lauric acid, myristic acid, palmitic acid, stearic acid, arachidic acid, and behenic acid.

Inorganic fine particles that have been treated with silicone oil are preferred for the inorganic fine particles used in the present invention, and inorganic fine particles treated with an organosilicon compound and a silicone oil are more preferred. This makes possible a favorable control of the hydrophobicity.

The method for treating the inorganic fine particles with a silicone oil can be exemplified by a method in which the silicone oil is directly mixed, using a mixer such as a Henschel mixer, with inorganic fine particles that have been treated with an organosilicon compound, and by a method in which the silicone oil is sprayed on the inorganic fine particles. Another example is a method in which the silicone oil is dissolved or dispersed in a suitable solvent; the inorganic fine particles are then added and mixed; and the solvent is removed.

In order to obtain a good hydrophobicity, the amount of silicone oil used for the treatment, expressed per 100 mass parts of the inorganic fine particles, is preferably from at least 1 mass part to not more than 40 mass parts and is more preferably from at least 3 mass parts to not more than 35 mass parts.

In order to impart an excellent flowability to the magnetic toner, the silica fine particles, titania fine particles, and alumina fine particles used by the present invention have a specific surface area as measured by the BET method based on nitrogen adsorption (BET specific surface area) preferably of from at least 20 $m^2/g$ to not more than 350 $m^2/g$ and more preferably of from at least 25 $m^2/g$ to not more than 300 $m^2/g$.

Measurement of the specific surface area (BET specific surface area) by the BET method based on nitrogen adsorption is performed based on JIS Z8830 (2001). A "TriStar300 (Shimadzu Corporation) automatic specific surface area pore distribution analyzer", which uses gas adsorption by a constant volume technique as its measurement procedure, is used as the measurement instrument.

The amount of addition of the inorganic fine particles, expressed per 100 mass parts of the magnetic toner particles, is preferably from at least 1.5 mass parts to not more than 3.0 mass parts of the inorganic fine particles, more preferably from at least 1.5 mass parts to not more than 2.6 mass parts, and even more preferably from at least 1.8 mass parts to not more than 2.6 mass parts.

Setting the amount of addition of the inorganic fine particles in the indicated range is also preferred from the standpoint of facilitating appropriate control of the coverage ratio A and B/A and also from the standpoint of the image density and fogging.

Exceeding 3.0 mass parts for the amount of addition of the inorganic fine particles, even if an external addition apparatus and an external addition method could be devised, gives rise to release of the silica fine particles and facilitates the appearance of, for example, a streak on the image.

In addition to the above-described inorganic fine particles, particles with a primary particle number-average particle diameter (D1) of from at least 80 nm to not more than 3 μm may be added to the magnetic toner of the present invention. For example, a lubricant, e.g., a fluororesin powder, zinc stearate powder, or polyvinylidene fluoride powder; a polish, e.g., a cerium oxide powder, a silicon carbide powder, a strontium titanate powder or a spacer particle such as silica, may also be added in small amounts that do not influence the effects of the present invention.

<Quantitation Methods for the Inorganic Fine Particles>

(1) Determination of the Content of Silica Fine Particles in the Magnetic Toner (Standard Addition Method)

3 g of the magnetic toner is introduced into an aluminum ring having a diameter of 30 mm and a pellet is prepared using a pressure of 10 tons. The silicon (Si) intensity is determined (Si intensity−1) by wavelength-dispersive x-ray fluorescence analysis (XRF). The measurement conditions are preferably optimized for the XRF instrument used and all of the intensity measurements in a series are performed using the same conditions. Silica fine particles with a primary particle number-average particle diameter of 12 nm are added at 1.0 mass % with reference to the magnetic toner and mixing is carried out with a coffee mill.

For the silica fine particles admixed at this time, silica fine particles with a primary particle number-average particle diameter of from at least 5 nm to not more than 50 nm can be used without affecting this determination.

After mixing, pellet fabrication is carried out as described above and the Si intensity (Si intensity−2) is determined also as described above. Using the same procedure, the Si intensity (Si intensity−3, Si intensity−4) is also determined for samples prepared by adding and mixing the silica fine particles at 2.0 mass % and 3.0 mass % of the silica fine particles with reference to the magnetic toner. The silica content (mass %) in the magnetic toner based on the standard addition method is calculated using Si intensities−1 to −4.

The titania content (mass %) in the magnetic toner and the alumina content (mass %) in the magnetic toner are determined using the standard addition method and the same procedure as described above for the determination of the silica content. That is, for the titania content (mass %), titania fine particles with a primary particle number-average particle diameter of from at least 5 nm to not more than 50 nm are added and mixed and the determination can be made by determining the titanium (Ti) intensity. For the alumina content (mass %), alumina fine particles with a primary particle number-average particle diameter of from at least 5 nm to not more than 50 nm are added and mixed and the determination can be made by determining the aluminum (Al) intensity.

(2) Separation of the Inorganic Fine Particles from the Magnetic Toner Particles 5 g of the magnetic toner is weighed using a precision balance into a lidded 200-mL plastic cup; 100 mL methanol is added; and dispersion is carried out for 5 minutes using an ultrasound disperser. The magnetic toner is held using a neodymium magnet and the supernatant is discarded. The process of dispersing with methanol and discarding the supernatant is carried out three times, followed by the addition of 100 mL of 10% NaOH and several drops of "Contaminon N" (a 10 mass % aqueous solution of a neutral pH 7 detergent for cleaning precision measurement instrumentation and comprising a nonionic surfactant, an anionic surfactant, and an organic builder, from Wako Pure Chemical Industries, Ltd.), light mixing, and then standing at quiescence for 24 hours. This is followed by re-separation using a neodymium magnet. Repeated washing with distilled water is carried out at this point until NaOH does not remain. The recovered particles are thoroughly dried using a vacuum drier to obtain particles A. The externally added silica fine particles are dissolved and removed by this process. Titania fine particles and alumina fine particles can remain present in particles A since they are sparingly soluble in 10% NaOH.

(3) Measurement of the Si Intensity in the Particles A 3 g of the particles A are introduced into an aluminum ring with a diameter of 30 mm; a pellet is fabricated using a pressure of 10 tons; and the Si intensity (Si intensity−5) is determined by wavelength-dispersive XRF. The silica content (mass %) in particles A is calculated using the Si intensity−5 and the Si intensities−1 to −4 used in the determination of the silica content in the magnetic toner.

(4) Separation of the Magnetic Body from the Magnetic Toner 100 mL of tetrahydrofuran is added to 5 g of the particles A with thorough mixing followed by ultrasound dispersion for 10 minutes. The magnetic particles are held with a magnet and the supernatant is discarded. This process is performed 5 times to obtain particles B. This process can almost completely remove the organic component, e.g., resins, outside the magnetic body. However, because a tetrahydrofuran-insoluble matter in the resin can remain, the particles B provided by this process are preferably heated to 800° C. in order to burn off the residual organic component, and the particles C obtained after heating are approximately the magnetic body that was present in the magnetic toner.

Measurement of the mass of the particles C yields the magnetic body content W (mass %) in the magnetic toner. In order to correct for the increment due to oxidation of the magnetic body, the mass of particles C is multiplied by 0.9666 ($Fe_2O_3 \rightarrow Fe_3O_4$).

(5) Measurement of the Ti Intensity and Al Intensity in the Separated Magnetic Body Ti and Al may be present as impurities or additives in the magnetic body. The amount of Ti and Al attributable to the magnetic body can be detected by FP quantitation in wavelength-dispersive XRF. The detected amounts of Ti and Al are converted to titania and alumina and the titania content and alumina content in the magnetic body are then calculated.

The amount of externally added silica fine particles, the amount of externally added titania fine particles, and the amount of externally added alumina fine particles are calculated by substituting the quantitative values obtained by the preceding procedures into the following formulas.

amount of externally added silica fine particles (mass %)=silica content(mass %) in the magnetic toner−silica content(mass %) in particle *A* amount of externally added titania fine particles (mass %)=titania content(mass %) in the magnetic toner−{titania content(mass %) in the magnetic body×magnetic body content *W*/100} amount of externally added alumina fine particles (mass %)=alumina content(mass %) in the magnetic toner−{alumina content(mass %) in the magnetic body×magnetic body content *W*/100}

(6) Calculation of the Proportion of Silica Fine Particles in the Metal Oxide Fine Particles Selected from the Group Consisting of Silica Fine Particles, Titania Fine Particles, and Alumina Fine Particles, for the Inorganic Fine Particles Fixed to the Magnetic Toner Particle Surface After carrying out the procedure, "Removing the unfixed inorganic fine particles", in the method described below for calculating the coverage ratio B and thereafter drying the magnetic toner, the proportion of the silica fine particles in the metal oxide fine particles can be calculated by carrying out the same procedures as in the method of (1) to (5) described above.

Viewed from the standpoint of the balance between the developing performance and the fixing performance, the magnetic toner of the present invention has a weight-average particle diameter (D4) preferably of 6.0 μm to 10.0 μm and more preferably 7.0 μm to 9.0 μm.

In addition, viewed from the standpoint of suppressing charge up, the average circularity of the magnetic toner of the present invention is preferably from at least 0.935 to not more than 0.955 and is more preferably from at least 0.938 to not more than 0.950. The average circularity of the magnetic toner of the present invention can be adjusted into the indicated range by controlling the method of producing the magnetic toner and the production conditions.

Examples of methods for producing the magnetic toner of the present invention are provided below, but there is no intent to limit the production method to these.

The magnetic toner of the present invention can be produced by any known method that has a step that enables adjustment of the coverage ratio A, B/A, and preferably has a step in which the average circularity is adjusted, while the other production steps are not particularly limited.

The following method is a favorable example of such a production method. First, the binder resin and magnetic body and as necessary other starting materials, e.g., a release agent and a charge control agent, are thoroughly mixed using a mixer such as a Henschel mixer or ball mill and are then melted, worked, and kneaded using a heated kneading apparatus such as a roll, kneader, or extruder to compatibilize the resins with each other.

The obtained melted and kneaded material is cooled and solidified and then coarsely pulverized, finely pulverized, and classified, and the external additives, e.g., inorganic fine particles, are externally added and mixed into the resulting magnetic toner particles to obtain the magnetic toner.

The mixer used here can be exemplified by the Henschel mixer (Mitsui Mining Co., Ltd.); Supermixer (Kawata Mfg. Co., Ltd.); Ribocone (Okawara Corporation); Nauta mixer, Turbulizer, and Cyclomix (Hosokawa Micron Corporation); Spiral Pin Mixer (Pacific Machinery & Engineering Co., Ltd.); Loedige Mixer (Matsubo Corporation); and Nobilta (Hosokawa Micron Corporation).

The aforementioned kneading apparatus can be exemplified by the KRC Kneader (Kurimoto, Ltd.); Buss Ko-Kneader (Buss Corp.); TEM extruder (Toshiba Machine Co., Ltd.); TEX twin-screw kneader (The Japan Steel Works, Ltd.); PCM Kneader (Ikegai Ironworks Corporation); three-roll mills, mixing roll mills, kneaders (Inoue Manufacturing Co., Ltd.); Kneadex (Mitsui Mining Co., Ltd.); model MS pressure kneader and Kneader-Ruder (Moriyama Mfg. Co., Ltd.); and Banbury mixer (Kobe Steel, Ltd.).

The aforementioned pulverizer can be exemplified by the Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

Among the preceding, the average circularity can be controlled by adjusting the exhaust gas temperature during micropulverization using a Turbo Mill. A lower exhaust gas temperature (for example, no more than 40° C.) provides a lower value for the average circularity while a higher exhaust gas temperature (for example, around 50° C.) provides a higher value for the average circularity.

The aforementioned classifier can be exemplified by the Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow Jet (Nittetsu Mining Co., Ltd.); Dispersion Separator (Nippon Pneumatic Mfg. Co., Ltd.); and YM Microcut (Yasukawa Shoji Co., Ltd.).

Screening devices that can be used to screen the coarse particles can be exemplified by the Ultrasonic (Koei Sangyo Co., Ltd.), Rezona Sieve and Gyro-Sifter (Tokuju Corporation), Vibrasonic System (Dalton Co., Ltd.), Soniclean (Sintokogio, Ltd.), Turbo Screener (Turbo Kogyo Co., Ltd.), Microsifter (Makino Mfg. Co., Ltd.), and circular vibrating sieves.

Figure 5:
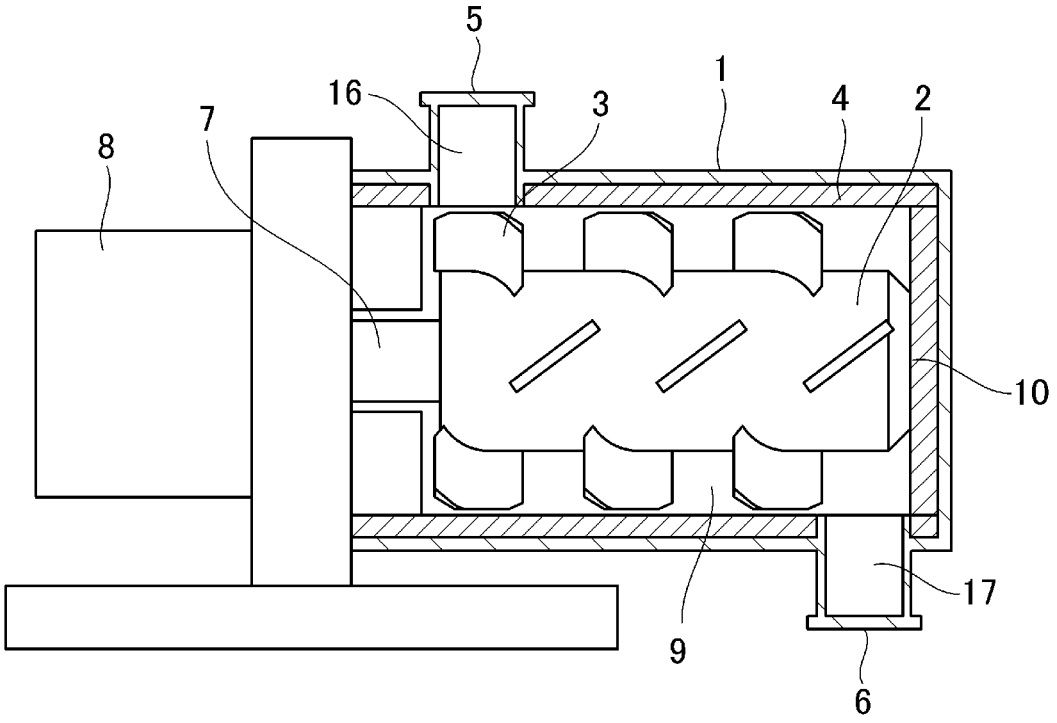
FIG. 5 is a schematic diagram that shows an example of a mixing process apparatus that can be used for the external addition and mixing of inorganic fine particles.

A known mixing process apparatus, e.g., the mixers described above, can be used as the mixing process apparatus for the external addition and mixing of the inorganic fine particles; however, an apparatus as shown in FIG. 5 is preferred from the standpoint of enabling facile control of the coverage ratio A, B/A, and the coefficient of variation on the coverage ratio A.

FIG. 5 is a schematic diagram that shows an example of a mixing process apparatus that can be used to carry out the external addition and mixing of the inorganic fine particles used by the present invention.

This mixing process apparatus readily brings about fixing of the inorganic fine particles to the magnetic toner particle surface because it has a structure that applies shear in a narrow clearance region to the magnetic toner particles and the inorganic fine particles.

Furthermore, as described below, the coverage ratio A, B/A, and the coefficient of variation on the coverage ratio A are easily controlled into the ranges preferred for the present invention because circulation of the magnetic toner particles and inorganic fine particles in the axial direction of the rotating member is facilitated and because a thorough and uniform mixing is facilitated prior to the development of fixing.

On the other hand, FIG. 5 is a schematic diagram that shows an example of the structure of the stirring member used in the aforementioned mixing process apparatus.

The external addition and mixing process for the inorganic fine particles is described below using FIGS. 5 and 6.

This mixing process apparatus that carries out external addition and mixing of the inorganic fine particles has a rotating member 2, on the surface of which at least a plurality of stirring members 3 are disposed; a drive member 8, which drives the rotation of the rotating member; and a main casing 1, which is disposed to have a gap with the stirring members 3.

It is important that the gap (clearance) between the inner circumference of the main casing 1 and the stirring member 3 be maintained constant and very small in order to apply a uniform shear to the magnetic toner particles and facilitate the fixing of the inorganic fine particles to the magnetic toner particle surface.

The diameter of the inner circumference of the main casing 1 in this apparatus is not more than twice the diameter of the outer circumference of the rotating member 2. In FIG. 5, an example is shown in which the diameter of the inner circumference of the main casing 1 is 1.7-times the diameter of the outer circumference of the rotating member 2 (the trunk diameter provided by subtracting the stirring member 3 from the rotating member 2). When the diameter of the inner circumference of the main casing 1 is not more than twice the diameter of the outer circumference of the rotating member 2, impact force is satisfactorily applied to the magnetic toner particles since the processing space in which forces act on the magnetic toner particles is suitably limited.

In addition, it is important that the aforementioned clearance be adjusted in conformity to the size of the main casing. Viewed from the standpoint of the application of adequate shear to the magnetic toner particles, it is important that the clearance be made from about at least 1% to not more than 5% of the diameter of the inner circumference of the main casing 1. Specifically, when the diameter of the inner circumference of the main casing 1 is approximately 130 mm, the clearance is preferably made approximately from at least 2 mm to not more than 5 mm; when the diameter of the inner circumference of the main casing 1 is about 800 mm, the clearance is preferably made approximately from at least 10 mm to not more than 30 mm.

In the process of the external addition and mixing of the inorganic fine particles in the present invention, mixing and external addition of the inorganic fine particles to the magnetic toner particle surface are performed using the mixing process apparatus by rotating the rotating member 2 by the drive member 8 and stirring and mixing the magnetic toner particles and inorganic fine particles that have been introduced into the mixing process apparatus.

Figure 6:
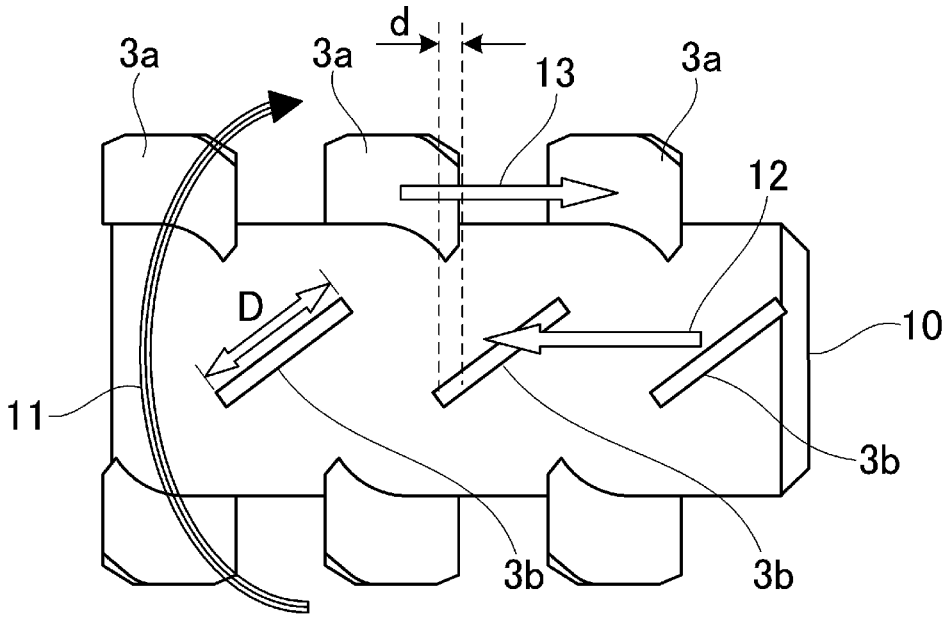
FIG. 6 is a schematic diagram that shows an example of the structure of a stirring member used in the mixing process apparatus.

As shown in FIG. 6, at least a portion of the plurality of stirring members 3 is formed as a forward transport stirring member 3*a* that, accompanying the rotation of the rotating member 2, transports the magnetic toner particles and inorganic fine particles in one direction along the axial direction of the rotating member. In addition, at least a portion of the plurality of stirring members 3 is formed as a back transport stirring member 3*b* that, accompanying the rotation of the rotating member 2, returns the magnetic toner particles and inorganic fine particles in the other direction along the axial direction of the rotating member.

Here, when the raw material inlet port 5 and the product discharge port 6 are disposed at the two ends of the main casing 1, as in FIG. 5, the direction toward the product discharge port 6 from the raw material inlet port 5 (the direction to the right in FIG. 5) is the "forward direction".

That is, as shown in FIG. 6, the face of the forward transport stirring member 3*a* is tilted so as to transport the magnetic toner particles in the forward direction (13). On the other hand, the face of the back transport stirring member 3*b* is tilted so as to transport the magnetic toner particles and the inorganic fine particles in the back direction (12).

By doing this, the external addition of the inorganic fine particles to the surface of the magnetic toner particles and mixing are carried out while repeatedly performing transport in the "forward direction" (13) and transport in the "back direction" (12).

In addition, with regard to the stirring members 3*a*, 3*b*, a plurality of members disposed at intervals in the circumferential direction of the rotating member 2 form a set. In the example shown in FIG. 6, two members at an interval of 180° with each other form a set of the stirring members 3*a*, 3*b* on the rotating member 2, but a larger number of members may form a set, such as three at an interval of 120° or four at an interval of 90°.

In the example shown in FIG. 6, a total of twelve stirring members 3*a*, 3*b* are formed at an equal interval.

Furthermore, D in FIG. 6 indicates the width of a stirring member and d indicates the distance that represents the overlapping portion of a stirring member. In FIG. 6, D is preferably a width that is approximately from at least 20% to not more than 30% of the length of the rotating member 2, when considered from the standpoint of bringing about an efficient transport of the magnetic toner particles and inorganic fine particles in the forward direction and back direction. FIG. 6 shows an example in which D is 23%. Furthermore, with regard to the stirring members 3*a* and 3*b*, when an extension line is drawn in the perpendicular direction from the location of the end of the stirring member 3*a*, a certain overlapping portion d of the stirring member with the stirring member 3*b* is preferably present. This serves to efficiently apply shear to the magnetic toner particles. This d is preferably from at least 10% to not more than 30% of D from the standpoint of the application of shear.

In addition to the shape shown in FIG. 6, the blade shape may be—insofar as the magnetic toner particles can be transported in the forward direction and back direction and the clearance is retained—a shape having a curved surface or a paddle structure in which a distal blade element is connected to the rotating member 2 by a rod-shaped arm.

The present invention will be described in additional detail herebelow with reference to the schematic diagrams of the apparatus shown in FIGS. 5 and 6.

The apparatus shown in FIG. 5 has a rotating member 2, which has at least a plurality of stirring members 3 disposed on its surface; a drive member 8 that drives the rotation of the rotating member 2; a main casing 1, which is disposed forming a gap with the stirring members 3; and a jacket 4, in which a heat transfer medium can flow and which resides on the inside of the main casing 1 and at the end surface 10 of the rotating member.

In addition, the apparatus shown in FIG. 5 has a raw material inlet port 5, which is formed on the upper side of the main casing 1 for the purpose of introducing the magnetic toner particles and the inorganic fine particles, and a product discharge port 6, which is formed on the lower side of the main casing 1 for the purpose of discharging, from the main casing to the outside, the magnetic toner that has been subjected to the external addition and mixing process.

The apparatus shown in FIG. 5 also has a raw material inlet port inner piece 16 inserted in the raw material inlet port 5 and a product discharge port inner piece 17 inserted in the product discharge port 6.

In the present invention, the raw material inlet port inner piece 16 is first removed from the raw material inlet port 5 and the magnetic toner particles are introduced into the processing space 9 from the raw material inlet port 5. Then, the inorganic fine particles are introduced into the processing space 9 from the raw material inlet port 5 and the raw material inlet port inner piece 16 is inserted. The rotating member 2 is subsequently rotated by the drive member 8 (11 represents the direction of rotation), and the thereby introduced material to be processed is subjected to the external addition and mixing process while being stirred and mixed by the plurality of stirring members 3 disposed on the surface of the rotating member 2.

The sequence of introduction may also be introduction of the inorganic fine particles through the raw material inlet port 5 first and then introduction of the magnetic toner particles through the raw material inlet port 5. In addition, the magnetic toner particles and the inorganic fine particles may be mixed in advance using a mixer such as a Henschel mixer and the mixture may thereafter be introduced through the raw material inlet port 5 of the apparatus shown in FIG. 5.

More specifically, with regard to the conditions for the external addition and mixing process, controlling the power of the drive member 8 to from at least 0.2 W/g to not more than 2.0 W/g is preferred in terms of obtaining the coverage ratio A, B/A, and the coefficient of variation on the coverage ratio A specified by the present invention. Controlling the power of the drive member 8 to from at least 0.6 W/g to not more than 1.6 W/g is more preferred.

When the power is lower than 0.2 W/g, it is difficult to obtain a high coverage ratio A, and B/A tends to be too low. On the other hand, B/A tends to be too high when 2.0 W/g is exceeded.

The processing time is not particularly limited, but is preferably from at least 3 minutes to not more than 10 minutes. When the processing time is shorter than 3 minutes, B/A tends to be low and a large coefficient of variation on the coverage ratio A is prone to occur. On the other hand, when the processing time exceeds 10 minutes, B/A conversely tends to be high and the temperature within the apparatus is prone to rise.

The rotation rate of the stirring members during external addition and mixing is not particularly limited; however, when, for the apparatus shown in FIG. 5, the volume of the processing space 9 in the apparatus is $2.0\times10^{-3}$ $m^3$, the rpm of the stirring members—when the shape of the stirring members 3 is as shown in FIG. 6—is preferably from at least 1000 rpm to not more than 3000 rpm. The coverage ratio A, B/A, and the coefficient of variation on the coverage ratio A specified for the present invention are readily obtained at from at least 1000 rpm to not more than 3000 rpm.

A particularly preferred processing method for the present invention has a pre-mixing step prior to the external addition and mixing process step. Inserting a pre-mixing step achieves a very uniform dispersion of the inorganic fine particles on the magnetic toner particle surface, and as a result a high coverage ratio A is readily obtained and the coefficient of variation on the coverage ratio A is readily reduced.

More specifically, the pre-mixing processing conditions are preferably a power of the drive member 8 of from at least 0.06 W/g to not more than 0.20 W/g and a processing time of from at least 0.5 minutes to not more than 1.5 minutes. It is difficult to obtain a satisfactorily uniform mixing in the pre-mixing when the loaded power is below 0.06 W/g or the processing time is shorter than 0.5 minutes for the pre-mixing processing conditions. When, on the other hand, the loaded power is higher than 0.20 W/g or the processing time is longer than 1.5 minutes for the pre-mixing processing conditions, the inorganic fine particles may become fixed to the magnetic toner particle surface before a satisfactorily uniform mixing has been achieved.

After the external addition and mixing process has been finished, the product discharge port inner piece 17 in the product discharge port 6 is removed and the rotating member 2 is rotated by the drive member 8 to discharge the magnetic toner from the product discharge port 6. As necessary, coarse particles and so forth may be separated from the obtained magnetic toner using a screen or sieve, for example, a circular vibrating screen, to obtain the magnetic toner.

Figure 4:
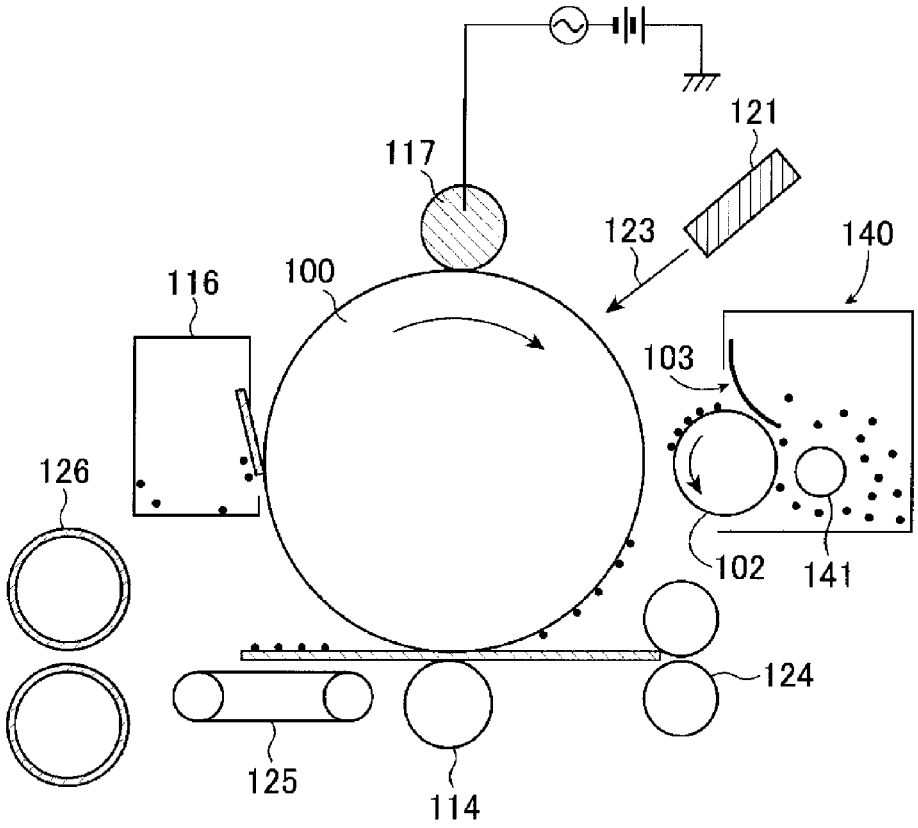
FIG. 4 is a schematic diagram that shows an example of an image-forming apparatus.

An example of an image-forming apparatus that can advantageously use the magnetic toner of the present invention is specifically described below with reference to FIG. 4. In FIG.

4, 100 is an electrostatic latent image-bearing member (also referred to below as a photosensitive member), and the following, inter alia, are disposed on its circumference: a charging member 117 (hereinafter also called a charging roller), a developing device 140 having a toner-carrying member 102, a transfer member 114 (transfer roller), a cleaner container 116, a fixing unit 126, and a register roller 124. The electrostatic latent image-bearing member 100 is charged by the charging member 117. Photoexposure is performed by irradiating the electrostatic latent image-bearing member 100 with laser light from a laser generator 121 to form an electrostatic latent image corresponding to the intended image. The electrostatic latent image on the electrostatic latent image-bearing member 100 is developed by the developing device 140 with a monocomponent toner to provide a toner image, and the toner image is transferred onto a transfer material by the transfer member 114, which contacts the electrostatic latent image-bearing member with the transfer material interposed therebetween. The toner image-bearing transfer material is conveyed to the fixing unit 126 and fixing on the transfer material is carried out. In addition, the toner remaining to some extent on the electrostatic latent image-bearing member is scraped off by the cleaning blade and is stored in the cleaner container 116.

The methods for measuring the various properties referenced by the present invention are described below.

<Calculation of the Coverage Ratio A>

The coverage ratio A is calculated in the present invention by analyzing, using Image-Pro Plus ver. 5.0 image analysis software (Nippon Roper Kabushiki Kaisha), the image of the magnetic toner surface taken with Hitachi's S-4800 ultrahigh resolution field emission scanning electron microscope (Hitachi High-Technologies Corporation). The conditions for image acquisition with the S-4800 are as follows.

(1) Specimen Preparation

An electroconductive paste is spread in a thin layer on the specimen stub (15 mm×6 mm aluminum specimen stub) and the magnetic toner is sprayed onto this. Additional blowing with air is performed to remove excess magnetic toner from the specimen stub and carry out thorough drying. The specimen stub is set in the specimen holder and the specimen stub height is adjusted to 36 mm with the specimen height gauge.

(2) Setting the Conditions for Observation with the S-4800

The coverage ratio A is calculated using the image obtained by backscattered electron imaging with the S-4800. The coverage ratio A can be measured with excellent accuracy using the backscattered electron image because the inorganic fine particles are charged up less than is the case with the secondary electron image.

Introduce liquid nitrogen to the brim of the anti-contamination trap located in the S-4800 housing and allow to stand for 30 minutes. Start the "PC-SEM" of the S-4800 and perform flashing (the FE tip, which is the electron source, is cleaned). Click the acceleration voltage display area in the control panel on the screen and press the [flashing] button to open the flashing execution dialog. Confirm a flashing intensity of 2 and execute. Confirm that the emission current due to flashing is 20 to 40 μA. Insert the specimen holder in the specimen chamber of the S-4800 housing. Press [home] on the control panel to transfer the specimen holder to the observation position.

Click the acceleration voltage display area to open the HV setting dialog and set the acceleration voltage to [0.8 kV] and the emission current to [20 μA]. In the [base] tab of the operation panel, set signal selection to [SE]; select [upper(U)] and [+BSE] for the SE detector; and select [L.A. 100] in the selection box to the right of [+BSE] to go into the observation mode using the backscattered electron image. Similarly, in the [base] tab of the operation panel, set the probe current of the electron optical system condition block to [Normal]; set the focus mode to [UHR]; and set WD to [3.0 mm]. Push the [ON] button in the acceleration voltage display area of the control panel and apply the acceleration voltage.

(3) Calculation of the Number-Average Particle Diameter (D1) of the Magnetic Toner Set the magnification to 5000× (5 k) by dragging within the magnification indicator area of the control panel. Turn the [COARSE] focus knob on the operation panel and perform adjustment of the aperture alignment where some degree of focus has been obtained. Click [Align] in the control panel and display the alignment dialog and select [beam]. Migrate the displayed beam to the center of the concentric circles by turning the STIGMA/ALIGNMENT knobs (X, Y) on the operation panel. Then select [aperture] and turn the STIGMA/ALIGNMENT knobs (X, Y) one at a time and adjust so as to stop the motion of the image or minimize the motion. Close the aperture dialog and focus with the autofocus. Focus by repeating this operation an additional two times.

After this, determine the number-average particle diameter (D1) by measuring the particle diameter at 300 magnetic toner particles. The particle diameter of the individual particle is taken to be the maximum diameter when the magnetic toner particle is observed.

(4) Focus Adjustment

For particles with a number-average particle diameter (D1) obtained in (3) of ±0.1 μm, with the center of the maximum diameter adjusted to the center of the measurement screen, drag within the magnification indication area of the control panel to set the magnification to 10000× (10 k). Turn the [COARSE] focus knob on the operation panel and perform adjustment of the aperture alignment where some degree of focus has been obtained. Click [Align] in the control panel and display the alignment dialog and select [beam]. Migrate the displayed beam to the center of the concentric circles by turning the STIGMA/ALIGNMENT knobs (X, Y) on the operation panel. Then select [aperture] and turn the STIGMA/ALIGNMENT knobs (X, Y) one at a time and adjust so as to stop the motion of the image or minimize the motion. Close the aperture dialog and focus using autofocus. Then set the magnification to 50000× (50 k); carry out focus adjustment as above using the focus knob and the STIGMA/ALIGNMENT knob; and re-focus using autofocus. Focus by repeating this operation. Here, because the accuracy of the coverage ratio measurement is prone to decline when the observation plane has a large tilt angle, carry out the analysis by making a selection with the least tilt in the surface by making a selection during focus adjustment in which the entire observation plane is simultaneously in focus.

(5) Image Capture

Carry out brightness adjustment using the ABC mode and take a photograph with a size of 640×480 pixels and store. Carry out the analysis described below using this image file. Take one photograph for each magnetic toner particle and obtain images for at least 30 magnetic toner particles.

(6) Image Analysis

The coverage ratio A is calculated in the present invention using the analysis software indicated below by subjecting the image obtained by the above-described procedure to binarization processing. When this is done, the above-described single image is divided into 12 squares and each is analyzed. However, when an inorganic fine particle with a particle diameter greater than or equal to 50 nm is present within a partition, calculation of the coverage ratio A is not performed for this partition.

The analysis conditions with the Image-Pro Plus ver. 5.0 image analysis software are as follows.

Software: Image-ProPlus5.1J

From "measurement" in the tool-bar, select "count/size" and then "option" and set the binarization conditions. Select 8 links in the object extraction option and set smoothing to 0. In addition, preliminary screening, fill vacancies, and envelope are not selected and the "exclusion of boundary line" is set to "none". Select "measurement items" from "measurement" in the tool-bar and enter 2 to $10^7$ for the area screening range.

The coverage ratio is calculated for analysis by marking out a square zone. Here, the area (C) of the zone is made 24000 to 26000 pixels. Automatic binarization is performed by "processing"-binarization and the total area (D) of the silica-free zone is calculated.

The coverage ratio a is calculated using the following formula from the area C of the square zone and the total area D of the silica-free zone.

$$\text{coverage ratio } a(\%)=100-(D/C\times 100)$$

As noted above, calculation of the coverage ratio a is carried out for at least 30 magnetic toner particles. The average value of all the obtained data is taken to be the coverage ratio A of the present invention.

<The Coefficient of Variation on the Coverage Ratio A>

The coefficient of variation on the coverage ratio A is determined in the present invention as follows. The coefficient of variation on the coverage ratio A is obtained using the following formula letting σ(A) be the standard deviation on all the coverage ratio data used in the calculation of the coverage ratio A described above.

$$\text{coefficient of variation}(\%)=\{\sigma(A)/A\}\times 100$$

<Calculation of the Coverage Ratio B>

The coverage ratio B is calculated by first removing the unfixed inorganic fine particles on the magnetic toner surface and thereafter carrying out the same procedure as followed for the calculation of the coverage ratio A.

(1) Removal of the Unfixed Inorganic Fine Particles

The unfixed inorganic fine particles are removed as described below. The present inventors investigated and then set these removal conditions in order to thoroughly remove the inorganic fine particles other than those embedded in the toner surface.

Figure 7:
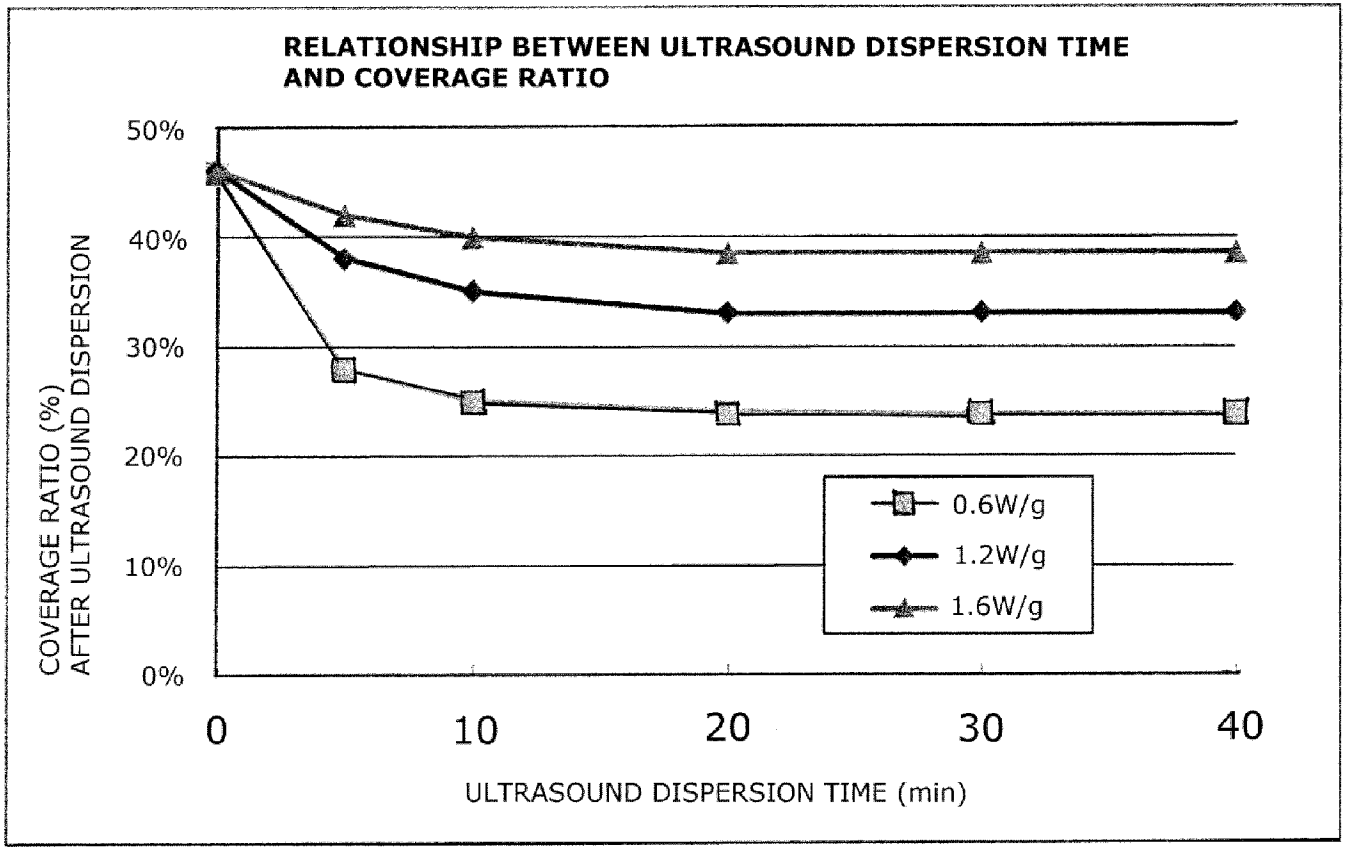
FIG. 7 is a diagram that shows an example of the relationship between the ultrasound dispersion time and the coverage ratio.

As an example, FIG. 7 shows the relationship between the ultrasound dispersion time and the coverage ratio calculated post-ultrasound dispersion, for magnetic toners in which the coverage ratio A was brought to 46% using the apparatus shown in FIG. 5 at three different external addition intensities. FIG. 7 was constructed by calculating, using the same procedure as for the calculation of coverage ratio A as described above, the coverage ratio of a magnetic toner provided by removing the inorganic fine particles by ultrasound dispersion by the method described below and then drying.

FIG. 7 demonstrates that the coverage ratio declines in association with removal of the inorganic fine particles by ultrasound dispersion and that, for all of the external addition intensities, the coverage ratio is brought to an approximately constant value by ultrasound dispersion for 20 minutes. Based on this, ultrasound dispersion for 30 minutes was regarded as providing a thorough removal of the inorganic fine particles other than the inorganic fine particles embedded in the toner surface and the thereby obtained coverage ratio was defined as coverage ratio B.

Considered in greater detail, 16.0 g of water and 4.0 g of Contaminon N (a neutral detergent from Wako Pure Chemical Industries, Ltd., product No. 037-10361) are introduced into a 30 mL glass vial and are thoroughly mixed. 1.50 g of the magnetic toner is introduced into the resulting solution and the magnetic toner is completely submerged by applying a magnet at the bottom. After this, the magnet is moved around in order to condition the magnetic toner to the solution and remove air bubbles.

The tip of a UH-50 ultrasound oscillator (from SMT Co., Ltd., the tip used is a titanium alloy tip with a tip diameter ϕ of 6 mm) is inserted so it is in the center of the vial and resides at a height of 5 mm from the bottom of the vial, and the inorganic fine particles are removed by ultrasound dispersion. After the application of ultrasound for 30 minutes, the entire amount of the magnetic toner is removed and dried. During this time, as little heat as possible is applied while carrying out vacuum drying at not more than 30° C.

(2) Calculation of the Coverage Ratio B

After the drying as described above, the coverage ratio of the toner is calculated as for the coverage ratio A described above, to obtain the coverage ratio B.

<Method of Measuring the Number-Average Particle Diameter of the Primary Particles of the Inorganic Fine Particles>

The number-average particle diameter of the primary particles of the inorganic fine particles is calculated from the inorganic fine particle image on the magnetic toner surface taken with Hitachi's S-4800 ultrahigh resolution field emission scanning electron microscope (Hitachi High-Technologies Corporation). The conditions for image acquisition with the S-4800 are as follows.

The same steps (1) to (3) as described above in "Calculation of the coverage ratio A" are carried out; focusing is performed by carrying out focus adjustment at a 50000× magnification of the magnetic toner surface as in (4); and the brightness is then adjusted using the ABC mode. This is followed by bringing the magnification to 100000×; performing focus adjustment using the focus knob and STIGMA/ALIGNMENT knobs as in (4); and focusing autofocus. The focus adjustment process is repeated to achieve focus at 100000×.

After this, the particle diameter is measured on at least 300 inorganic fine particles on the magnetic toner surface and the primary particle number-average particle diameter (D1) is determined. Here, because the inorganic fine particles are also present as aggregates, the maximum diameter is determined on what can be identified as the primary particle, and the primary particle number-average particle diameter (D1) is obtained by taking the arithmetic average of the obtained maximum diameters.

<Method for Measuring the Weight-Average Particle Diameter (D4) of the Magnetic Toner>

The weight-average particle diameter (D4) of the magnetic toner is calculated as follows. The measurement instrument used is a "Coulter Counter Multisizer 3" (registered trademark, from Beckman Coulter, Inc.), a precision particle size distribution measurement instrument operating on the pore electrical resistance principle and equipped with a 100 μm aperture tube. The measurement conditions are set and the measurement data are analyzed using the accompanying dedicated software, i.e., "Beckman Coulter Multisizer 3 Version 3.51" (from Beckman Coulter, Inc.). The measurements are carried at 25000 channels for the number of effective measurement channels.

The aqueous electrolyte solution used for the measurements is prepared by dissolving special-grade sodium chloride in ion-exchanged water to provide a concentration of about 1 mass % and, for example, "ISOTON II" (from Beckman Coulter, Inc.) can be used.

The dedicated software is configured as follows prior to measurement and analysis.

In the "modify the standard operating method (SOM)" screen in the dedicated software, the total count number in the control mode is set to 50000 particles; the number of measurements is set to 1 time; and the Kd value is set to the value obtained using "standard particle 10.0 μm" (from Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube have previously been removed by the "aperture flush" function of the dedicated software.

(2) Approximately 30 mL of the above-described aqueous electrolyte solution is introduced into a 100-mL flatbottom glass beaker. To this is added as dispersant about 0.3 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of ion-exchanged water is introduced into the water tank of this ultrasound disperser and approximately 2 mL of Contaminon N is added to the water tank.

(4) The beaker described in (2) is set into the beaker holder opening on the ultrasound disperser and the ultrasound disperser is started. The height of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of toner is added to the aqueous electrolyte solution in small aliquots and dispersion is carried out. The ultrasound dispersion treatment is continued for an additional 60 seconds. The water temperature in the water bath is controlled as appropriate during ultrasound dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of about 5%. Measurement is then performed until the number of measured particles reaches 50000.

(7) The measurement data is analyzed by the previously cited dedicated software provided with the instrument and the weight-average particle diameter (D4) is calculated. When set to graph/volume % with the dedicated software, the "average diameter" on the "analysis/volumetric statistical value (arithmetic average)" screen is the weight-average particle diameter (D4).

<Method of measuring the 1H-NMR (nuclear magnetic resonance) of the magnetic toner and others> measurement instrument: FT-NMR instrument, JNM-EX400 (JEOL Ltd.)

measurement frequency: 400 MHz pulse condition: 5.0 μs data points: 32768 delay time: 25 sec frequency range: 10500 Hz number of integrations: 16 measurement temperature: 40° C.

sample: Preparation is carried out by introducing 200 mg of the measurement sample into a sample tube having a diameter of 5 mm; adding $CDCl_3$ (0.05% TMS) as solvent; and carrying out dissolution in a thermostat 40° C.

<Method of measuring, on the magnetic toner, the peak temperature (Cm) of the highest endothermic peak originating from the crystalline polyester, the amounts of heat absorption [ΔH1 and ΔH2], and the peak temperature (Wm) of the highest endothermic peak originating from the release agent>

Cm, ΔH1, ΔH2, and Wm are measured or calculated based on ASTM D 3418-82 using a [DSC-7 (PerkinElmer Inc.)] differential scanning calorimeter (DSC).

Temperature correction in the instrument detection section uses the melting points of indium and zinc, and correction of the amount of heat uses the heat of fusion of indium.

[For Cm, ΔH1, and ΔH2]

10 mg of the measurement sample (magnetic toner) is precisely weighed out. This is introduced into an aluminum pan, and, using an empty aluminum pan as the reference, the measurement is performed at normal temperature and normal humidity at a rate of temperature rise of 10° C./min in the measurement temperature range between 30 and 200° C. For the measurement, the temperature is raised to 200° C. at a rate of temperature rise of 10° C./min and is then dropped to 30° C. at 10° C./min and is thereafter again raised a second time at a rate of temperature rise of 10° C./min.

When the magnetic toner is used for the measurement sample, Cm is taken to be the peak temperature of the highest endothermic peak obtained in the first temperature ramp up.

In addition, in the temperature region in which the endothermic peak appears, ΔH1 is taken to be the amount of heat absorption calculated from the area bounded by a differential scanning calorimetric curve "a" that displays the highest endothermic peak obtained during the first temperature ramp up and the baseline of the differential scanning calorimetric curve "a". On the other hand, ΔH2 is taken to be the amount of heat absorption calculated from the area bounded by a differential scanning calorimetric curve that displays the highest endothermic peak obtained during the second temperature ramp up and the baseline of the differential scanning calorimetric curve "b".

[For Wm]

In the above-described method for measuring Cm, Wm is taken to be the peak temperature of the highest endothermic peak originating with the release agent and obtained in the first temperature ramp up process.

The peak originating with the crystalline polyester and the peak originating with the release agent are distinguished by checking the structure of the constituent molecules by NMR measurement on the magnetic toner.

In addition, the content of the release agent in the magnetic toner is determined by comparing the endothermic peak for the magnetic toner with the endothermic peak measured by DSC on the release agent simple substance extracted from the magnetic toner with a Soxhlet extractor using hexane solvent.

EXAMPLES

The present invention is more specifically described through the examples and comparative examples provided below, but the present invention is in no way restricted to these. The "parts" and "%" in the examples and comparative examples are on a mass basis unless specifically indicated otherwise.

Crystalline Polyester 1 Production Example

The starting monomer shown in Table 1 (42 mass parts of 1,4-butanediol, 8 mass parts of 1,6-hexanediol, and 50 mass parts of fumaric acid) and 0.05 mass parts of tertiary-butylcatechol (TBC) were introduced into a reactor equipped with a stirrer, thermometer, and outflow condenser and an esterification reaction was run for 5 hours at 160° C. under a nitrogen atmosphere. The temperature was then raised to 200° C. and a polycondensation reaction was run for 1 hour. The reaction was continued for 1 hour at 8.3 kPa to obtain crystalline polyester 1. The properties of the obtained crystalline polyester 1 are shown in Table 1.

Crystalline Polyester 2 to 10 Production Examples

Crystalline polyesters 2 to 10 were obtained proceeding as for the production of crystalline polyester 1, but changing the amounts of starting monomer addition as indicated in Table 1. The properties of the obtained crystalline polyesters 2 to 10 are shown in Table 1.

TABLE 1

| | starting monomer | | | | | | peak temperature of the endothermic peak measured by DSC |
|---|---|---|---|---|---|---|---|
| | starting monomer 1 | [mass parts] | starting monomer 2 | [mass parts] | starting monomer 3 | [mass parts] | [° C.] |
| crystalline polyester 1 | 1,4-butanediol | 42 | 1,6-hexanediol | 8 | fumaric acid | 50 | 121 |
| crystalline polyester 2 | 1,4-butanediol | 47 | 1,6-hexanediol | 3 | fumaric acid | 50 | 130 |
| crystalline polyester 3 | 1,4-butanediol | 10 | 1,6-hexanediol | 40 | fumaric acid | 50 | 70 |
| crystalline polyester 4 | 1,4-butanediol | 46 | 1,6-hexanediol | 4 | fumaric acid | 50 | 128 |
| crystalline polyester 5 | 1,4-butanediol | 35 | 1,6-hexanediol | 15 | fumaric acid | 50 | 110 |
| crystalline polyester 6 | 1,4-butanediol | 25 | 1,6-hexanediol | 25 | fumaric acid | 50 | 95 |
| crystalline polyester 7 | diethylene glycol | 31 | decanedicarboxylic acid | 69 | — | — | 78 |
| crystalline polyester 8 | 1,4-butanediol | 12 | 1,6-hexanediol | 38 | fumaric acid | 50 | 73 |
| crystalline polyester 9 | diethylene glycol | 18 | decanedicarboxylic acid | 82 | — | — | 132 |
| crystalline polyester 10 | 1,4-butanediol | 9 | 1,6-hexanediol | 41 | fumaric acid | 50 | 68 |

Magnetic Toner Particle 1 Production Example

| | |
|---|---|
| crystalline polyester 1 | 30 mass parts |
| styrene/n-butyl acrylate copolymer (styrene:n-butyl acrylate mass ratio = 78:22, glass-transition temperature = 58° C., peak molecular weight = 8500) | 70 mass parts |
| magnetic body (composition: $Fe_3O_4$, shape: spherical, average particle diameter: 0.21 μm, magnetic characteristics for 795.8 kA/m: $H_c$ = 5.5 kA/m, $\sigma_s$ = 84.0 $Am^2/kg$, and $\sigma_r$ = 6.4 $Am^2/kg$) | 100 mass parts |
| charge control agent (Hodogaya Chemical Co., Ltd.: T-77) | 1.5 mass parts |
| release agent 1 (Nippon Seiro Co., Ltd.: HNP-9) | 2 mass parts |

The raw materials listed above were preliminarily mixed using a Henschel mixer and were then melt-kneaded using a twin-screw extruder and allowed to spontaneously cool at room temperature. This was followed by a pulverization step and classification step to obtain magnetic toner particle 1 having a weight-average particle diameter of 9 μm. The production conditions for magnetic toner particle 1 are given in Table 2.

TABLE 2

| magnetic toner particle | crystalline polyester (crystalline PES) | release agent | number of parts of release agent addition | production conditions |
|---|---|---|---|---|
| magnetic toner particle 1 | crystalline PES 1 | release agent 1 | 2 | after kneading, the resin is spontaneously cooled at room temperature |
| magnetic toner particle 2 | crystalline PES 1 | release agent 1 | 2 | immediately after kneading, the cooling rate of the resin is made 6.70 times that of spontaneous cooling at room temperature |
| magnetic toner particle 3 | crystalline PES 2 | release agent 2 | 2 | immediately after kneading, the cooling rate of the resin is made 6.70 times that of spontaneous cooling at room temperature |
| magnetic toner particle 4 | crystalline PES 2 | release agent 2 | 2 | after kneading, the resin is spontaneously cooled at room temperature |
| magnetic toner particle 5 | crystalline PES 2 | release agent 2 | 2 | immediately after kneading, the cooling rate of the resin is made 0.40 times that of spontaneous cooling at room temperature |
| magnetic toner particle 6 | crystalline PES 1 | release agent 1 | 2 | immediately after kneading, the cooling rate of the resin is made 0.40 times that of spontaneous cooling at room temperature |
| magnetic toner particle 7 | crystalline PES 3 | release agent 1 | 2 | immediately after kneading, the cooling rate of the resin is made 0.40 times that of spontaneous cooling at room temperature |
| magnetic toner particle 8 | crystalline PES 3 | release agent 1 | 2 | after kneading, the resin is spontaneously cooled at room temperature |
| magnetic toner particle 9 | crystalline PES 3 | release agent 1 | 2 | immediately after kneading, the cooling rate of the resin is made 6.70 times that of spontaneous cooling at room temperature |
| magnetic toner particle 10 | crystalline PES 1 | release agent 1 | 2 | after kneading, the resin is spontaneously cooled at room temperature |
| magnetic toner particle 11 | crystalline PES 4 | release agent 3 | 2 | after kneading, the resin is spontaneously cooled at room temperature |
| magnetic toner particle 12 | crystalline PES 4 | release agent 1 | 2 | after kneading, the resin is spontaneously cooled at room temperature |
| magnetic toner particle 13 | crystalline PES 5 | release agent 4 | 2 | after kneading, the resin is spontaneously cooled at room temperature |
| magnetic toner particle 14 | crystalline PES 6 | release agent 5 | 2 | after kneading, the resin is spontaneously cooled at room temperature |
| magnetic toner particle 15 | crystalline PES 7 | release agent 5 | 2 | after kneading, the resin is spontaneously cooled at room temperature |
| magnetic toner particle 16 | crystalline PES 5 | release agent 1 | 2 | after kneading, the resin is spontaneously cooled at room temperature |
| magnetic toner particle 17 | crystalline PES 4 | release agent 6 | 2 | after kneading, the resin is spontaneously cooled at room temperature |
| magnetic toner particle 18 | crystalline PES 4 | release agent 7 | 2 | after kneading, the resin is spontaneously cooled at room temperature |
| magnetic toner particle 19 | crystalline PES 5 | release agent 8 | 2 | after kneading, the resin is spontaneously cooled at room temperature |
| magnetic toner particle 20 | crystalline PES 6 | release agent 9 | 2 | after kneading, the resin is spontaneously cooled at room temperature |
| magnetic toner particle 21 | crystalline PES 8 | release agent 5 | 2 | after kneading, the resin is spontaneously cooled at room temperature |
| magnetic toner particle 22 | crystalline PES 5 | release agent 10 | 2 | after kneading, the resin is spontaneously cooled at room temperature |
| magnetic toner particle 23 | crystalline PES 1 | release agent 11 | 1 | after kneading, the resin is spontaneously cooled at room temperature |
| magnetic toner particle 24 | crystalline PES 1 | release agent 11 | 10 | after kneading, the resin is spontaneously cooled at room temperature |
| magnetic toner particle 25 | crystalline PES 1 | release agent 11 | 0.5 | after kneading, the resin is spontaneously cooled at room temperature |
| magnetic toner particle 26 | crystalline PES 1 | release agent 11 | 12 | after kneading, the resin is spontaneously cooled at room temperature |
| magnetic toner particle 27 | crystalline PES 2 | release agent 11 | 0.5 | immediately after kneading, the cooling rate of the resin is made 6.96 times that of spontaneous cooling at room temperature |
| magnetic toner particle 28 | crystalline PES 9 | release agent 11 | 0.5 | immediately after kneading, the cooling rate of the resin is made 6.71 times that of spontaneous cooling at room temperature |
| magnetic toner particle 29 | crystalline PES 9 | release agent 11 | 0.5 | immediately after kneading, the cooling rate of the resin is made 0.38 times that of spontaneous cooling at room temperature |
| magnetic toner particle 30 | crystalline PES 2 | release agent 11 | 0.5 | immediately after kneading, the cooling rate of the resin is made 0.32 times that of spontaneous cooling at room temperature |
| magnetic toner particle 31 | crystalline PES 3 | release agent 11 | 0.5 | immediately after kneading, the cooling rate of the resin is made 0.32 times that of spontaneous cooling at room temperature |
| magnetic toner particle 32 | crystalline PES 10 | release agent 11 | 0.5 | immediately after kneading, the cooling rate of the resin is made 0.38 times that of spontaneous cooling at room temperature |
| magnetic toner particle 33 | crystalline PES 10 | release agent 11 | 0.5 | immediately after kneading, the cooling rate of the resin is made 6.71 times that of spontaneous cooling at room temperature |
| magnetic toner particle 34 | crystalline PES 3 | release agent 11 | 0.5 | immediately after kneading, the cooling rate of the resin is made 6.96 times that of spontaneous cooling at room temperature |
| magnetic toner particle 35 | described in text | | | after kneading, the resin is spontaneously cooled at room temperature |
| magnetic toner particle 36 | | | | after kneading, the resin is spontaneously cooled at room temperature |

Magnetic Toner 1 Production Example

An external addition and mixing process was carried out using the apparatus shown in FIG. 5 on the magnetic toner particle 1 provided by Magnetic Toner 1 Particle Production Example.

In this example, the apparatus shown in FIG. 5 was used, in which the diameter of the inner circumference of the main casing 1 was 130 mm; the apparatus used had a volume for the processing space 9 of $2.0\times10^{-3}$ $m^3$; the rated power for the drive member 8 was 5.5 kW; and the stirring member 3 had the shape given in FIG. 6. The overlap width d in FIG. 6 between the stirring member 3*a* and the stirring member 3*b* was 0.25 D with respect to the maximum width D of the stirring member 3, and the clearance between the stirring member 3 and the inner circumference of the main casing 1 was 3.0 mm.

100 mass parts of magnetic toner particle 1 and 2.00 mass parts of silica fine particle 1 (obtained by subjecting 100 mass parts of a silica [BET: 200 $m^2$/g and primary particle number-average particle diameter (D1): 12 nm] to surface treatment with 10 mass parts of hexamethyldisilazane and then treating 100 mass parts of this treated silica with 10 mass parts dimethylsilicone oil) were introduced into the apparatus shown in FIG. 5 having the apparatus structure described above.

A pre-mixing was carried out after the introduction in order to uniformly mix the magnetic toner particles and the silica fine particles prior to the external addition processing. The pre-mixing conditions were as follows: a drive member 8 power of 0.1 W/g (drive member 8 rotation rate of 150 rpm) and a processing time of 1 minute.

The external addition and mixing process was carried out once pre-mixing was finished. With regard to the conditions for the external addition and mixing process, the processing time was 5 minutes and the peripheral velocity of the outermost end of the stirring member 3 was adjusted to provide a constant drive member 8 power of 1.0 W/g (drive member 8 rotation rate of 1800 rpm). The conditions for the external addition and mixing process are shown in Table 5.

After the external addition and mixing process, the coarse particles and so forth were removed using a circular vibrating screen equipped with a screen having a diameter of 500 mm and an aperture of 75 μm to obtain magnetic toner 1. A value of 14 nm was obtained when magnetic toner 1 was submitted to magnification and observation with a scanning electron microscope and the number-average particle diameter of the primary particles of the silica fine particles on the magnetic toner surface was measured. The properties of the obtained magnetic toner 1 are shown in Table 3.

TABLE 3

| | toner particle | content of silica fine particles in the inorganic fine particles (mass %) | content of silica fine particles in the fixed inorganic fine particles (mass %) | coverage ratio A (%) | B/A | coefficient of variation for coverage ratio A (%) | Cm | Cm-Wm | ΔH1-ΔH2 |
|---|---|---|---|---|---|---|---|---|---|
| magnetic toner 1 | magnetic toner particle 1 | 100 | 100 | 55.1 | 0.69 | 6.5 | 121 | 46 | 0.79 |
| magnetic toner 2 | magnetic toner particle 1 | 100 | 100 | 58.2 | 0.73 | 6.2 | 121 | 46 | 0.78 |
| magnetic toner 3 | magnetic toner particle 1 | 100 | 100 | 50.5 | 0.65 | 8.1 | 121 | 46 | 0.78 |
| magnetic toner 4 | magnetic toner particle 1 | 85 | 80 | 54.2 | 0.66 | 6.8 | 121 | 46 | 0.79 |
| magnetic toner 5 | magnetic toner particle 1 | 85 | 90 | 54.9 | 0.69 | 6.8 | 121 | 46 | 0.77 |
| magnetic toner 6 | magnetic toner particle 2 | 100 | 100 | 55.0 | 0.68 | 6.5 | 121 | 46 | 5.30 |
| magnetic toner 7 | magnetic toner particle 3 | 100 | 100 | 55.1 | 0.69 | 6.5 | 130 | 47 | 5.29 |
| magnetic toner 8 | magnetic toner particle 4 | 100 | 100 | 55.0 | 0.66 | 6.5 | 130 | 47 | 0.79 |
| magnetic toner 9 | magnetic toner particle 5 | 100 | 100 | 55.3 | 0.69 | 6.5 | 130 | 47 | 0.30 |
| magnetic toner 10 | magnetic toner particle 6 | 100 | 100 | 55.2 | 0.70 | 6.5 | 121 | 46 | 0.29 |
| magnetic toner 11 | magnetic toner particle 7 | 100 | 100 | 55.1 | 0.68 | 6.6 | 70 | −5 | 0.30 |
| magnetic toner 12 | magnetic toner particle 8 | 100 | 100 | 55.0 | 0.69 | 6.5 | 70 | −5 | 0.79 |
| magnetic toner 13 | magnetic toner particle 9 | 100 | 100 | 55.1 | 0.71 | 6.5 | 70 | −5 | 5.30 |
| magnetic toner 14 | magnetic toner particle 10 | 100 | 100 | 56.0 | 0.84 | 6.6 | 121 | 46 | 0.79 |
| magnetic toner 15 | magnetic toner particle 10 | 100 | 100 | 55.7 | 0.52 | 6.5 | 121 | 46 | 0.77 |
| magnetic toner 16 | magnetic toner particle 10 | 100 | 100 | 45.5 | 0.72 | 6.6 | 121 | 46 | 0.77 |
| magnetic toner 17 | magnetic toner particle 10 | 100 | 100 | 68.4 | 0.67 | 6.5 | 121 | 46 | 0.78 |
| magnetic toner 18 | magnetic toner particle 10 | 100 | 100 | 45.2 | 0.84 | 6.5 | 121 | 46 | 0.79 |
| magnetic toner 19 | magnetic toner particle 10 | 100 | 100 | 45.9 | 0.52 | 6.6 | 121 | 46 | 0.80 |
| magnetic toner 20 | magnetic toner particle 10 | 100 | 100 | 69.1 | 0.84 | 6.5 | 121 | 46 | 0.80 |
| magnetic toner 21 | magnetic toner particle 10 | 100 | 100 | 69.0 | 0.52 | 6.6 | 121 | 46 | 0.79 |
| magnetic toner 22 | magnetic toner particle 10 | 85 | 85 | 54.7 | 0.68 | 6.5 | 121 | 46 | 0.78 |
| magnetic toner 23 | magnetic toner particle 10 | 85 | 85 | 55.3 | 0.69 | 6.6 | 121 | 46 | 0.77 |
| magnetic toner 24 | magnetic toner particle 11 | 100 | 100 | 55.2 | 0.67 | 6.5 | 128 | 35 | 0.79 |
| magnetic toner 25 | magnetic toner particle 12 | 100 | 100 | 55.1 | 0.67 | 6.5 | 128 | 53 | 0.79 |
| magnetic toner 26 | magnetic toner particle 13 | 100 | 100 | 56.7 | 0.69 | 6.5 | 110 | 52 | 0.78 |
| magnetic toner 27 | magnetic toner particle 14 | 100 | 100 | 57.2 | 0.72 | 6.5 | 95 | 52 | 0.78 |
| magnetic toner 28 | magnetic toner particle 15 | 100 | 100 | 54.4 | 0.71 | 6.5 | 78 | 35 | 0.79 |
| magnetic toner 29 | magnetic toner particle 16 | 100 | 100 | 55.3 | 0.69 | 6.5 | 110 | 35 | 0.80 |
| magnetic toner 30 | magnetic toner particle 17 | 100 | 100 | 55.5 | 0.72 | 6.5 | 128 | 30 | 0.79 |
| magnetic toner 31 | magnetic toner particle 18 | 100 | 100 | 55.6 | 0.69 | 6.6 | 128 | 58 | 0.78 |
| magnetic toner 32 | magnetic toner particle 19 | 100 | 100 | 55.3 | 0.73 | 6.5 | 110 | 57 | 0.80 |
| magnetic toner 33 | magnetic toner particle 20 | 100 | 100 | 58.0 | 0.68 | 6.5 | 95 | 57 | 0.79 |
| magnetic toner 34 | magnetic toner particle 21 | 100 | 100 | 54.0 | 0.67 | 6.6 | 73 | 30 | 0.79 |
| magnetic toner 35 | magnetic toner particle 22 | 100 | 100 | 52.3 | 0.71 | 6.5 | 110 | 32 | 0.78 |
| magnetic toner 36 | magnetic toner particle 23 | 100 | 100 | 58.6 | 0.69 | 6.5 | 121 | 56 | 0.78 |
| magnetic toner 37 | magnetic toner particle 24 | 100 | 100 | 57.3 | 0.70 | 6.5 | 121 | 56 | 0.80 |
| magnetic toner 38 | magnetic toner particle 25 | 100 | 100 | 55.6 | 0.67 | 9.9 | 121 | 56 | 0.79 |
| magnetic toner 39 | magnetic toner particle 26 | 100 | 100 | 59.0 | 0.68 | 9.9 | 121 | 56 | 0.79 |
| magnetic toner 40 | magnetic toner particle 25 | 100 | 100 | 54.3 | 0.69 | 12.4 | 121 | 56 | 0.80 |
| comparative magnetic toner 1 | magnetic toner particle 27 | 100 | 100 | 54.9 | 0.72 | 12.4 | 130 | 64 | 5.50 |
| comparative magnetic toner 2 | magnetic toner particle 28 | 100 | 100 | 56.0 | 0.73 | 12.4 | 132 | 66 | 5.30 |
| comparative magnetic toner 3 | magnetic toner particle 29 | 100 | 100 | 58.2 | 0.71 | 12.4 | 132 | 66 | 0.30 |
| comparative magnetic toner 4 | magnetic toner particle 30 | 100 | 100 | 54.2 | 0.69 | 12.4 | 130 | 64 | 0.25 |
| comparative magnetic toner 5 | magnetic toner particle 31 | 100 | 100 | 55.5 | 0.66 | 12.3 | 70 | 4 | 0.25 |
| comparative magnetic toner 6 | magnetic toner particle 32 | 100 | 100 | 55.9 | 0.69 | 12.4 | 68 | 2 | 0.30 |
| comparative magnetic toner 7 | magnetic toner particle 33 | 100 | 100 | 56.1 | 0.68 | 12.4 | 68 | 2 | 5.30 |
| comparative magnetic toner 8 | magnetic toner particle 34 | 100 | 100 | 55.5 | 0.72 | 12.4 | 70 | 4 | 5.50 |
| comparative magnetic toner 9 | magnetic toner particle 25 | 100 | 100 | 46.1 | 0.47 | 12.3 | 121 | 56 | 0.79 |
| comparative magnetic toner 10 | magnetic toner particle 25 | 100 | 100 | 43.0 | 0.53 | 13.4 | 121 | 56 | 0.79 |
| comparative magnetic toner 11 | magnetic toner particle 25 | 100 | 100 | 46.9 | 0.88 | 12.5 | 121 | 56 | 0.77 |

TABLE 3-continued

| | toner particle | content of silica fine particles in the inorganic fine particles (mass %) | content of silica fine particles in the fixed inorganic fine particles (mass %) | coverage ratio A (%) | B/A | coefficient of variation for coverage ratio A (%) | Cm | Cm-Wm | ΔH1-ΔH2 |
|---|---|---|---|---|---|---|---|---|---|
| comparative magnetic toner 12 | magnetic toner particle 25 | 100 | 100 | 44.6 | 0.85 | 12.7 | 121 | 56 | 0.80 |
| comparative magnetic toner 13 | magnetic toner particle 25 | 100 | 100 | 68.1 | 0.47 | 11.9 | 121 | 56 | 0.79 |
| comparative magnetic toner 14 | magnetic toner particle 25 | 100 | 100 | 72.2 | 0.53 | 12.1 | 121 | 56 | 0.77 |
| comparative magnetic toner 15 | magnetic toner particle 25 | 100 | 100 | 63.0 | 0.88 | 13.1 | 121 | 56 | 0.79 |
| comparative magnetic toner 16 | magnetic toner particle 25 | 100 | 100 | 71.4 | 0.82 | 12.9 | 121 | 56 | 0.79 |
| comparative magnetic toner 17 | magnetic toner particle 25 | 80 | 80 | 55.5 | 0.69 | 12.4 | 121 | 56 | 0.80 |
| comparative magnetic toner 18 | magnetic toner particle 1 | 77 | 78 | 75.6 | 0.22 | 14.3 | 121 | 46 | 0.79 |
| comparative magnetic toner 19 | magnetic toner particle 35 | 80 | 80 | 40.0 | 0.18 | 13.2 | 121 | — | 10.30 |
| comparative magnetic toner 20 | magnetic toner particle 36 | 67 | 55 | 42.0 | 0.17 | 11.1 | 66 | −54 | 0.10 |
| comparative magnetic toner 21 | magnetic toner particle 1 | 43 | 41 | 52.0 | 0.29 | 14.3 | 121 | 46 | 0.79 |

Magnetic Toner 2 Production Example

A magnetic toner 2 was obtained by following the same procedure as in the Magnetic Toner 1 Production Example, with the exception that silica fine particle 1 was changed to silica fine particle 2, which was obtained by performing the same surface treatment as with silica fine particle 1, but on a silica that had a BET specific surface area of 300 $m^2/g$ and a primary particle number-average particle diameter (D1) of 8 nm. The external addition conditions for and properties of magnetic toner 2 are shown in Table 3 and Table 5.

Magnetic Toner 3 Production Example

A magnetic toner 3 was obtained by following the same procedure as in Magnetic Toner 1 Production Example, with the exception that silica fine particle 3 was used in place of silica fine particle 1. Silica fine particle 3 was obtained by performing the same surface treatment as with silica fine particle 1, but on a silica that had a BET specific surface area of 90 $m^2/g$ and a primary particle number-average particle diameter (D1) of 25 nm. When the magnetic toner 3 was observed with a scanning electron microscope, a value of 28 nm was obtained when the number-average particle diameter of the primary particles of the silica fine particles on the magnetic toner surface was measured. The external addition conditions and properties of magnetic toner 3 are shown in Table 3 and Table 5.

Magnetic Toner 4 Production Example

The external addition and mixing process was performed according to the following procedure using an external addition apparatus (the apparatus of FIG. 5), which is the same as the apparatus in Magnetic Toner 1 Production Example.

As shown in Table 5, the silica fine particle 1 (2.00 mass parts) added in Magnetic Toner 1 Production Example was changed to silica fine particle 1 (1.70 mass parts) and titania fine particles (0.30 mass parts).

First, 100 mass parts of magnetic toner particle 1, 0.70 mass parts of silica fine particle 1, and 0.30 mass parts of the titania fine particles were introduced into the apparatus in FIG. 5 and the same pre-mixing as in Magnetic Toner 1 Production Example was then performed.

In the external addition and mixing process carried out once pre-mixing was finished, processing was performed for a processing time of 2 minutes while adjusting the peripheral velocity of the outermost end of the stirring member 3 so as to provide a constant drive member 8 power of 1.0 W/g (drive member 8 rotation rate of 1800 rpm), after which the mixing process was temporarily stopped. The supplementary introduction of the remaining silica fine particles 1 (1.00 mass part with reference to 100 mass parts of magnetic toner particle 1) was then performed, followed by again processing for a processing time of 3 minutes while adjusting the peripheral velocity of the outermost end of the stirring member 3 so as to provide a constant drive member 8 power of 1.0 W/g (drive member 8 rotation rate of 1800 rpm), thus providing a total external addition and mixing process time of 5 minutes. After the external addition and mixing process, the coarse particles and so forth were removed using a circular vibrating screen as in Magnetic Toner 1 Production Example to obtain magnetic toner 4. The external addition conditions for magnetic toner 4 are given in Table 3 and the properties of magnetic toner 4 are given in Table 5.

Magnetic Toner 5 Production Example

The external addition and mixing process was performed according to the following procedure using the same external addition apparatus as that of FIG. 5 in Magnetic Toner 1 Production Example.

As shown in Table 5, the silica fine particle 1 (2.00 mass parts) added in Magnetic Toner 1 Production Example was changed to silica fine particle 1 (1.70 mass parts) and titania fine particles (0.30 mass parts).

First, 100 mass parts of magnetic toner particle 1 and 1.70 mass parts of silica fine particle 1 were introduced into the apparatus in FIG. 5 and the same pre-mixing as in Magnetic Toner 1 Production Example was then performed.

In the external addition and mixing process carried out once pre-mixing was finished, processing was performed for a processing time of 2 minutes while adjusting the peripheral velocity of the outermost end of the stirring member 3 so as to provide a constant drive member 8 power of 1.0 W/g (drive member 8 rotation rate of 1800 rpm), after which the mixing process was temporarily stopped. The supplementary introduction of the remaining titania fine particles (0.30 mass parts with reference to 100 mass parts of magnetic toner particle 1) was then performed, followed by again processing for a processing time of 3 minutes while adjusting the peripheral velocity of the outermost end of the stirring member 3 so as to provide a constant drive member 8 power of 1.0 W/g (drive member 8 rotation rate of 1800 rpm), thus providing a total external addition and mixing process time of 5 minutes. After the external addition and mixing process, the coarse particles and so forth were removed using a circular vibrating screen as in Magnetic Toner 1 Production Example to obtain magnetic toner 5. The external addition conditions for magnetic toner 5 are given in Table 3 and the properties thereof are given in Table 5.

Magnetic Toner Particle 2 to 36 Production Examples

Magnetic toner particles 2 to 36 were obtained proceeding as in the Magnetic Toner 1 Production Example, but changing the type of crystalline polyester and release agent and the production conditions as shown in Table 2. The production conditions for the obtained magnetic toner particles 2 to 36 are given in Table 2. The type and properties of the release agent are given in Table 4.

TABLE 4

| | type of release agent | Wm [° C.] |
|---|---|---|
| release agent 1 | HNP9 from Nippon Seiro Co., Ltd. | 75 |
| release agent 2 | Hi-Mic-1080 from Nippon Seiro Co., Ltd. | 83 |
| release agent 3 | hexacosanoic acid ester of dipentaerythritol | 93 |
| release agent 4 | Paraffin Wax 135 from Nippon Seiro Co., Ltd. | 58 |
| release agent 5 | myristyl myristate | 43 |
| release agent 6 | Hi-Mic-2095 from Nippon Seiro Co., Ltd. | 98 |
| release agent 7 | Hi-Mic-1045 from Nippon Seiro Co., Ltd. | 70 |
| release agent 8 | Paraffin Wax 125 from Nippon Seiro Co., Ltd. | 53 |
| release agent 9 | lauryl laurate | 38 |
| release agent 10 | HNP51 from Nippon Seiro Co., Ltd. | 78 |
| release agent 11 | Paraffin Wax 150 from Nippon Seiro Co., Ltd. | 66 |

Magnetic Toner 6 to 40 Production Examples and Comparative Magnetic Toner 1 to 17 Production Examples Magnetic toners 6 to 40 and comparative magnetic toners 1 to 17 were obtained using the magnetic toner particles shown in Table 5 in Magnetic Toner 1 Production Example in place of magnetic toner particle 1 and by performing respective external addition processing using the external addition formulations, external addition apparatuses, and external addition conditions shown in Table 5. The properties of magnetic toners 6 to 40 and comparative magnetic toners 1 to 17 are shown in Table 3.

Anatase titanium oxide fine particles (BET specific surface area: 80 $m^2/g$, primary particle number-average particle diameter (D1): 15 nm, treated with 12 mass % isobutyltrimethoxysilane) were used for the titania fine particles referenced in Table 5 and alumina fine particles (BET specific surface area: 80 $m^2/g$, primary particle number-average particle diameter (D1): 17 nm, treated with 10 mass % isobutyltrimethoxysilane) were used for the alumina fine particles referenced in Table 5.

Table 3 also gives the content (mass %) of silica fine particles for the addition of titania fine particles and/or alumina fine particles in addition to silica fine particles.

For comparative magnetic toners 9 to 11 and 13 and 14, pre-mixing was not performed and the external addition and mixing process was carried out immediately after introduction (indicated in Table 5 as "no pre-mixing").

The hybridizer referenced in Table 5 is the Hybridizer Model 5 (Nara Machinery Co., Ltd.), and the Henschel mixer referenced in Table 5 is the FM10C (Mitsui Miike Chemical Engineering Machinery Co., Ltd.).

The properties of the magnetic toners are given in Table 3.

TABLE 5

| | magnetic toner particle | silica fine particles (mass parts) | titania fine particles (mass parts) | alumina fine particles (mass parts) | external addition apparatus | operating conditions for the external addition apparatus | operating time by the external addition apparatus |
|---|---|---|---|---|---|---|---|
| magnetic toner 1 | magnetic toner particle 1 | 2.00 | — | — | apparatus of FIG. 5 | 1.0 W/g (1800 rpm) | 5 min |
| magnetic toner 2 | magnetic toner particle 1 | 2.00 | — | — | apparatus of FIG. 5 | 1.0 W/g (1800 rpm) | 5 min |
| magnetic toner 3 | magnetic toner particle 1 | 2.00 | — | — | apparatus of FIG. 5 | 1.0 W/g (1800 rpm) | 5 min |
| magnetic toner 4 | magnetic toner particle 1 | 1.70 | 0.30 | — | apparatus of FIG. 5 | 1.0 W/g (1800 rpm) | 5 min |
| magnetic toner 5 | magnetic toner particle 1 | 1.70 | 0.30 | — | apparatus of FIG. 5 | 1.0 W/g (1800 rpm) | 5 min |
| magnetic toner 6 | magnetic toner particle 2 | 2.00 | — | — | apparatus of FIG. 5 | 1.0 W/g (1800 rpm) | 5 min |
| magnetic toner 7 | magnetic toner particle 3 | 2.00 | — | — | apparatus of FIG. 5 | 1.0 W/g (1800 rpm) | 5 min |
| magnetic toner 8 | magnetic toner particle 4 | 2.00 | — | — | apparatus of FIG. 5 | 1.0 W/g (1800 rpm) | 5 min |
| magnetic toner 9 | magnetic toner particle 5 | 2.00 | — | — | apparatus of FIG. 5 | 1.0 W/g (1800 rpm) | 5 min |
| magnetic toner 10 | magnetic toner particle 6 | 2.00 | — | — | apparatus of FIG. 5 | 1.0 W/g (1800 rpm) | 5 min |
| magnetic toner 11 | magnetic toner particle 7 | 2.00 | — | — | apparatus of FIG. 5 | 1.0 W/g (1800 rpm) | 5 min |
| magnetic toner 12 | magnetic toner particle 8 | 2.00 | — | — | apparatus of FIG. 5 | 1.0 W/g (1800 rpm) | 5 min |
| magnetic toner 13 | magnetic toner particle 9 | 2.00 | — | — | apparatus of FIG. 5 | 1.0 W/g (1800 rpm) | 5 min |

TABLE 5-continued

| | magnetic toner particle | silica fine particles (mass parts) | titania fine particles (mass parts) | alumina fine particles (mass parts) | external addition apparatus | operating conditions for the external addition apparatus | operating time by the external addition apparatus |
|---|---|---|---|---|---|---|---|
| magnetic toner 14 | magnetic toner particle 10 | 2.31 | — | — | apparatus of FIG. 5 | 1.6 W/g (2500 rpm) | 5 min |
| magnetic toner 15 | magnetic toner particle 10 | 2.31 | — | — | apparatus of FIG. 5 | 0.6 W/g (1400 rpm) | 5 min |
| magnetic toner 16 | magnetic toner particle 10 | 1.50 | — | — | apparatus of FIG. 5 | 1.0 W/g (1800 rpm) | 5 min |
| magnetic toner 17 | magnetic toner particle 10 | 2.60 | — | — | apparatus of FIG. 5 | 1.0 W/g (1800 rpm) | 5 min |
| magnetic toner 18 | magnetic toner particle 10 | 1.50 | — | — | apparatus of FIG. 5 | 1.6 W/g (2500 rpm) | 5 min |
| magnetic toner 19 | magnetic toner particle 10 | 1.50 | — | — | apparatus of FIG. 5 | 0.6 W/g (1400 rpm) | 5 min |
| magnetic toner 20 | magnetic toner particle 10 | 2.60 | — | — | apparatus of FIG. 5 | 1.6 W/g (2500 rpm) | 5 min |
| magnetic toner 21 | magnetic toner particle 10 | 2.60 | — | — | apparatus of FIG. 5 | 0.6 W/g (1400 rpm) | 5 min |
| magnetic toner 22 | magnetic toner particle 10 | 1.70 | 0.30 | — | apparatus of FIG. 5 | 1.0 W/g (1800 rpm) | 5 min |
| magnetic toner 23 | magnetic toner particle 10 | 1.70 | 0.16 | 0.14 | apparatus of FIG. 5 | 1.0 W/g (1800 rpm) | 5 min |
| magnetic toner 24 | magnetic toner particle 11 | 2.00 | — | — | apparatus of FIG. 5 | 1.0 W/g (1800 rpm) | 5 min |
| magnetic toner 25 | magnetic toner particle 12 | 2.00 | — | — | apparatus of FIG. 5 | 1.0 W/g (1800 rpm) | 5 min |
| magnetic toner 26 | magnetic toner particle 13 | 2.00 | — | — | apparatus of FIG. 5 | 1.0 W/g (1800 rpm) | 5 min |
| magnetic toner 27 | magnetic toner particle 14 | 2.00 | — | — | apparatus of FIG. 5 | 1.0 W/g (1800 rpm) | 5 min |
| magnetic toner 28 | magnetic toner particle 15 | 2.00 | — | — | apparatus of FIG. 5 | 1.0 W/g (1800 rpm) | 5 min |
| magnetic toner 29 | magnetic toner particle 16 | 2.00 | — | — | apparatus of FIG. 5 | 1.0 W/g (1800 rpm) | 5 min |
| magnetic toner 30 | magnetic toner particle 17 | 2.00 | — | — | apparatus of FIG. 5 | 1.0 W/g (1800 rpm) | 5 min |
| magnetic toner 31 | magnetic toner particle 18 | 2.00 | — | — | apparatus of FIG. 5 | 1.0 W/g (1800 rpm) | 5 min |
| magnetic toner 32 | magnetic toner particle 19 | 2.00 | — | — | apparatus of FIG. 5 | 1.0 W/g (1800 rpm) | 5 min |
| magnetic toner 33 | magnetic toner particle 20 | 2.00 | — | — | apparatus of FIG. 5 | 1.0 W/g (1800 rpm) | 5 min |
| magnetic toner 34 | magnetic toner particle 21 | 2.00 | — | — | apparatus of FIG. 5 | 1.0 W/g (1800 rpm) | 5 min |
| magnetic toner 35 | magnetic toner particle 22 | 2.00 | — | — | apparatus of FIG. 5 | 1.0 W/g (1800 rpm) | 5 min |
| magnetic toner 36 | magnetic toner particle 23 | 2.00 | — | — | apparatus of FIG. 5 | 1.0 W/g (1800 rpm) | 5 min |
| magnetic toner 37 | magnetic toner particle 24 | 2.00 | — | — | apparatus of FIG. 5 | 1.0 W/g (1800 rpm) | 5 min |
| magnetic toner 38 | magnetic toner particle 25 | 2.00 | — | — | hybridizer | 6000 rpm | 5 min |
| magnetic toner 39 | magnetic toner particle 26 | 2.00 | — | — | hybridizer | 6000 rpm | 5 min |
| magnetic toner 40 | magnetic toner particle 25 | 2.31 | — | — | hybridizer | 6000 rpm | 5 min |
| comparative magnetic toner 1 | magnetic toner particle 27 | 2.31 | — | — | hybridizer | 6000 rpm | 5 min |
| comparative magnetic toner 2 | magnetic toner particle 28 | 2.31 | — | — | hybridizer | 6000 rpm | 5 min |
| comparative magnetic toner 3 | magnetic toner particle 29 | 2.31 | — | — | hybridizer | 6000 rpm | 5 min |
| comparative magnetic toner 4 | magnetic toner particle 30 | 2.31 | — | — | hybridizer | 6000 rpm | 5 min |
| comparative magnetic toner 5 | magnetic toner particle 31 | 2.31 | — | — | hybridizer | 6000 rpm | 5 min |
| comparative magnetic toner 6 | magnetic toner particle 32 | 2.31 | — | — | hybridizer | 6000 rpm | 5 min |
| comparative magnetic toner 7 | magnetic toner particle 33 | 2.31 | — | — | hybridizer | 6000 rpm | 5 min |
| comparative magnetic toner 8 | magnetic toner particle 34 | 2.31 | — | — | hybridizer | 6000 rpm | 5 min |
| comparative magnetic toner 9 | magnetic toner particle 25 | 1.50 | — | — | apparatus of FIG. 5 | no pre-mixing 0.6 W/g (1400 rpm) | 3 min |
| comparative magnetic toner 10 | magnetic toner particle 25 | 1.20 | — | — | apparatus of FIG. 5 | no pre-mixing 0.6 W/g (1400 rpm) | 3 min |
| comparative magnetic toner 11 | magnetic toner particle 25 | 1.50 | — | — | apparatus of FIG. 5 | no pre-mixing 2.2 W/g (3300 rpm) | 5 min |
| comparative magnetic toner 12 | magnetic toner particle 25 | 1.50 | — | — | hybridizer | 7000 rpm | 8 min |
| comparative magnetic toner 13 | magnetic toner particle 25 | 2.60 | — | — | apparatus of FIG. 5 | no pre-mixing 0.6 W/g (1400 rpm) | 3 min |
| comparative magnetic toner 14 | magnetic toner particle 25 | 3.00 | — | — | apparatus of FIG. 5 | no pre-mixing 1.6 W/g (2500 rpm) | 3 min |
| comparative magnetic toner 15 | magnetic toner particle 25 | 1.00 | — | — | Henschel mixer | 4000 rpm | 2 min |
| comparative magnetic toner 16 | magnetic toner particle 25 | 2.00 | — | — | Henschel mixer | 4000 rpm | 2 min |
| comparative magnetic toner 17 | magnetic toner particle 25 | 1.85 | 0.46 | — | apparatus of FIG. 5 | 1.0 W/g (1800 rpm) | 5 min |
| comparative magnetic toner 18 | magnetic toner particle 1 | 2.80 | — | — | Henschel mixer | 3200 rpm | 5 min |
| comparative magnetic toner 19 | magnetic toner particle 35 | | | | | described in text | |
| comparative magnetic toner 20 | magnetic toner particle 36 | | | | | described in text | |
| comparative magnetic toner 21 | magnetic toner particle 1 | | | | | described in text | |

Comparative Magnetic Toner 18 Production Example

Comparative magnetic toner 18 was obtained by mixing and attaching, using a Henschel mixer, 2.8 mass parts of a hydrophobic silica (HVK2150 from Clariant) and 0.8 mass parts of strontium titanate (SW-350 from Titan Kogyo, Ltd.) to 100 mass parts of magnetic toner particle 1. The properties of comparative magnetic toner 18 are given in Table 3.

Comparative Magnetic Toner 19 Production Example

| | |
|---|---|
| ethylene glycol | 50 mass parts |
| neopentyl glycol | 65 mass parts |
| terephthalic acid | 96 mass parts |

These monomers were charged to a flask; the temperature was raised to 190° C. over 1 hour; and 1.2 mass parts of dibutyltin oxide was introduced.

The temperature was raised from 190° C. to 240° C. over 6 hours while distilling out the produced water and the dehydration condensation reaction was continued for an additional 4 hours at 240° C. to produce a noncrystalline polyester having an acid value of 10.0 mg KOH/g, a weight-average molecular weight of 12000, and a glass-transition temperature of 60° C.

Then, while in the molten state as obtained, this was transported at a rate of 100 g per minute to a Cavitron CD1010 (Eurotec Co., Ltd.). A dilute aqueous ammonia with a concentration of 0.37 mass %, prepared by the dilution with ion-exchanged water of reagent aqueous ammonia, was introduced into a separately provided aqueous medium tank and was transported into the Cavitron, at the same time as the polyester resin melt, at a rate of 0.1 liter per minute while heating to 120° C. with a heat exchanger. The Cavitron was operated at a rotor rotation rate of 60 Hz and a pressure of 5 $kg/cm^2$ to yield a dispersion of noncrystalline resin fine particles having a volume-average particle diameter of 160 nm, a solids fraction of 30 mass %, a glass-transition temperature of 60° C., and a weight-average molecular weight of 12000.

| | |
|---|---|
| magnetite | 49 mass parts |
| ionic surfactant (Neogen RK, Dai-ichi Kogyo Seiyaku Co., Ltd.) | 1 mass part |
| ion-exchanged water | 250 mass parts |

These components were mixed and were preliminarily dispersed for 10 minutes using a homogenizer (Ultra-Turrax: IKA) and were then dispersed for 15 minutes at a pressure of 245 MPa using an opposing impingement-type wet pulverizer (Altimizer: Sugino Machine Limited) to obtain a magnetic particle dispersion.

| | |
|---|---|
| crystalline polyester 1 | 50 mass parts |
| anionic surfactant (Neogen SC, Dai-ichi Kogyo Seiyaku Co., Ltd.) | 2 mass parts |
| ion-exchanged water | 200 mass parts |

These components were heated to 120° C. and thoroughly dispersed with an Ultra-Turrax T50 from IKA and were then dispersed with a pressurized ejection-type homogenizer; collection was performed when the volume-average particle diameter reached 180 nm to obtain a dispersion of crystalline resin fine particles.

| | |
|---|---|
| the dispersion of noncrystalline resin fine particles | 150 mass parts |
| the magnetic particle dispersion | 70 mass parts |
| the dispersion of crystalline resin fine particles | 50 mass parts |
| polyaluminum chloride | 0.4 mass parts |
| ion-exchanged water | 100 mass parts |

These components were mixed and were thoroughly mixed dispersed in a round stainless steel flask using an Ultra-Turrax T50 from IKA; this was followed by heating the flask on a heating oil bath to 48° C. while stirring. After maintaining for 60 minutes at 48° C., a supplementary addition of 70 mass parts of the dispersion of noncrystalline resin fine particles was slowly carried out. After this, the pH in the system was adjusted to 8.0 using an aqueous sodium hydroxide solution having a concentration of 0.5 mol/L; the stainless steel flask was then tightly closed and the stirrer shaft was magnetically sealed; and heating to 90° C. was performed while continuing to stir and this was maintained for 3 hours.

After the completion of the reaction, cooling was carried out at a rate of temperature decline of 2° C./minute; filtration was performed with thorough washing with ion-exchanged water; and solid-liquid separation was performed to obtain magnetic toner particle 35.

Comparative magnetic toner 19 was obtained by adding the following to this magnetic toner particle 35 so as to provide a coverage ratio A on the magnetic toner particle surface of 40% and mixing with a Henschel mixer: silica fine particles having a primary particle number-average particle diameter of 40 nm, which had been subjected to a surface hydrophobing treating with hexamethyldisilazane, and meta-titanic acid compound fine particles having a primary particle number-average particle diameter of 20 nm, which were the reaction product of meta-titanic acid and isobutyltrimethoxysilane. The properties of comparative magnetic toner 19 are given in Table 3.

Comparative Magnetic Toner 20 Production Example

| | |
|---|---|
| 1,4-butanediol | 2070 g |
| fumaric acid | 2535 g |
| trimellitic anhydride | 291 g |
| hydroquinone | 4.9 g |

These raw materials were introduced into a 5-L four-neck flask equipped with a nitrogen introduction tube, a water separator, a stirrer, and a thermocouple and were reacted for 5 hours at 160° C. This was followed by raising the temperature to 200° C. and reacting for 1 hour and then by reacting for 1 hour at 8.3 kPa to obtain a resin A.

| | |
|---|---|
| bisphenol A-2 mol propylene oxide adduct (BPA-PO) | 2000 g |
| bisphenol A-2 mol ethylene oxide adduct (BPA-EO) | 800 g |
| terephthalic acid | 600 g |
| dodecenylsuccinic anhydride | 500 g |
| trimellitic anhydride | 350 g |
| dibutyltin oxide | 4 g |

These raw materials were introduced into a 5-L four-neck flask equipped with a water separator, a stirrer, and a thermocouple and were reacted for 8 hours at 220° C. This was followed by additional reaction at 8.3 kPa until the prescribed softening point was reached, thereby yielding a resin a.

| | |
|---|---|
| bisphenol A-2 mol propylene oxide adduct (BPA-PO) | 2000 g |
| bisphenol A-2 mol ethylene oxide adduct (BPA-EO) | 800 g |
| terephthalic acid | 400 g |
| fumaric acid | 600 g |
| trimellitic anhydride | 550 g |

These raw materials were introduced into a 5-L four-neck flask equipped with a water separator, a stirrer, and a thermocouple and were reacted for 8 hours at 220° C. This was followed by additional reaction at 8.3 kPa until a softening point of 66° C. was reached, thereby yielding a resin b.

| | |
|---|---|
| resin A | 10 mass parts |
| resin a | 60 mass parts |
| resin b | 30 mass parts |
| magnetic body (MTS-106HD from Toda Kogyo Corp.) | 100 mass parts |
| polypropylene wax (Sanyo Chemical Industries, Ltd.: VISKOL 550P, melting point: 120° C.) | 2 mass parts |
| charge control agent (Hodogaya Chemical Co., Ltd.: T-77) | 1 mass part |

(Hodogaya Chemical Co., Ltd.: T-77)

These raw materials were mixed using a Henschel mixer and were then melt-kneaded using a twin-screw extruder. The resulting melt-kneaded material was pulverized and classified using a "Model IDS-2" high-speed jet mill pulverizer/classifier (Nippon Pneumatic Mfg. Co., Ltd.) to provide a weight-average particle diameter of 8 μm, thereby yielding magnetic toner particle 36.

Using a Henschel mixer, the following were first added and mixed as additives to 521.0 g of magnetic toner particle 36 with vigorous stirring at 1500 rpm: 2.0 g of anatase-type titanium oxide fine particles [BET specific surface area: 80 $m^2/g$, primary particle number-average particle diameter (D1): 15 nm, treated with 12 mass % isobutyltrimethoxysilane] and 2.0 g of silica fine particles that had a primary particle number-average particle diameter of 40 nm and that had been subjected to a surface hydrophobing treatment with hexamethyldisilazane. After this, 2.0 g of silica fine particles that had a primary particle number-average particle diameter of 40 nm and that had been subjected to a surface hydrophobing treatment with hexamethyldisilazane was added as an additive using a Henschel mixer at 1000 rpm, thereby yielding comparative magnetic toner 20. The properties of comparative magnetic toner 20 are given in Table 3.

Comparative Magnetic Toner 21 Production Example 4.6 mass parts of meta-titanic acid (primary particle number-average particle diameter=30 nm, treated with 50 mass % i-butyltrimethoxysilane) was added to 100 mass parts of magnetic toner particle 1 and blending was carried out with a 20-L Henschel mixer at peripheral velocity 40 m/s×20 minutes. After this, 3.4 mass parts spherical silica (primary particle number-average particle diameter=130 nm, sol-gel method, treated with 8 mass % hexamethyldisilazane [HMDS]) was added and additional blending was performed at a peripheral velocity of 40 m/s for 10 minutes to yield comparative magnetic toner 21. The properties of comparative magnetic toner 21 are given in Table 3.

Example 1

Evaluation of the Electrostatic Offset and Image Density Pre- and Post-Long-Term Use The electrostatic offset was evaluated in a high-temperature, high-humidity environment (32.5° C., 85% RH) because electrostatic offset becomes unfavorable in a high-temperature, high-humidity environment, which facilitates broadening of the charge distribution in a magnetic toner.

A Laser Jet 3005 laser beam printer from Hewlett-Packard was used for the evaluation apparatus: it had been modified so the fixation temperature in the fixing apparatus could be freely set and to have a process speed of 350 mm/sec.

In addition, the process cartridge was modified to double its capacity, and this modified process cartridge was filled with 1000 g of magnetic toner 1. This modified cartridge was installed in the evaluation apparatus and held overnight in a high-temperature, high-humidity environment (32.5° C., 85% RH).

On the next day, an initial check was carried out in a high-temperature, high-humidity environment (32.5° C., 85% RH) by adjusting the fixation temperature in the evaluation apparatus 25° C. downward from the default value; outputting a 3 cm-by-3 cm discrete dot image (set to provide an image density, measured using a MacBeth reflection densitometer (MacBeth Corporation), of 0.5 to 0.6) on FOX RIVER BOND paper (90 $g/m^2$) that had been held for 24 hours in a high-temperature, high-humidity environment (32.5° C., 85% RH); and visually evaluating the level of electrostatic offset produced in the solid white region below the dot image. The results of the evaluation are shown in Table 6.

The scale used to evaluate the electrostatic offset is given below.

A: cannot be visually observed

B: can be very weakly observed

C: a region of electrostatic offset is immediately seen, but a region lacking electrostatic offset is also present D: a 3 cm-by-3 cm square can be clearly observed The scale used to evaluate the image density, on the other hand, is given below. For the image density, a solid image region was formed and the density of this solid image was measured using a MacBeth reflection densitometer (MacBeth Corporation).

A: very good (at least 1.45)

B: good (less than 1.45 and at least 1.40)

C: fair (less than 1.40 and at least 1.35)

D: poor (less than 1.35)

(Post-Durability Test Check)

After the initial check, a 5000-print durability test was run using ordinary A4 paper (75 $g/m^2$): one print of a horizontal line pattern with a print percentage of 1.5% equaled one job, and a mode was used in which the machine was set to come to a momentary stop between jobs, after which the next job was started. The same check as above was carried out after this test. The results of the evaluation are given in Table 6.

[Evaluation of the Storage Stability]

Approximately 10 g of magnetic toner 1 was placed in a 100-cc plastic cup and held for 3 days at 50° C., after which the effect on the toner was visually evaluated. The scale for evaluating the storage stability is given below. The results of the evaluation are given in Table 6.

A: very good (no change)
B: good (aggregates are seen, but are easily broken up)
C: practical (difficult to break up)
D: impractical (caking)

Examples 2 to 40

Image output and testing were carried out as in Example 1, but using the magnetic toners described in Table 6. The results of these evaluations are given in Table 6.

Comparative Examples 1 to 21

Image output and testing were carried out as in Example 1, but using the magnetic toners described in Table 6. The results of these evaluations are given in Table 6.

TABLE 6

| | | initial check | | post-durability test check | | |
|---|---|---|---|---|---|---|
| | magnetic toner | image density | electrostatic offset | image density | electrostatic offset | storage stability |
| Example 1 | magnetic toner 1 | A (1.50) | A | A (1.52) | A | A |
| Example 2 | magnetic toner 2 | A (1.49) | A | A (1.48) | A | A |
| Example 3 | magnetic toner 3 | A (1.46) | A | A (1.47) | B | A |
| Example 4 | magnetic toner 4 | A (1.52) | A | A (1.49) | A | A |
| Example 5 | magnetic toner 5 | A (1.51) | A | A (1.51) | A | A |
| Example 6 | magnetic toner 6 | A (1.48) | A | B (1.43) | B | A |
| Example 7 | magnetic toner 7 | A (1.52) | B | B (1.44) | B | A |
| Example 8 | magnetic toner 8 | A (1.51) | A | A (1.48) | B | A |
| Example 9 | magnetic toner 9 | A (1.48) | B | A (1.45) | B | A |
| Example 10 | magnetic toner 10 | A (1.47) | A | A (1.49) | B | A |
| Example 11 | magnetic toner 11 | A (1.45) | B | A (1.48) | C | A |
| Example 12 | magnetic toner 12 | A (1.46) | B | A (1.48) | C | A |
| Example 13 | magnetic toner 13 | B (1.44) | B | B (1.44) | C | A |
| Example 14 | magnetic toner 14 | B (1.44) | B | A (1.46) | B | A |
| Example 15 | magnetic toner 15 | B (1.43) | B | A (1.47) | B | A |
| Example 16 | magnetic toner 16 | B (1.41) | A | B (1.43) | B | B |
| Example 17 | magnetic toner 17 | B (1.42) | B | A (1.49) | B | A |
| Example 18 | magnetic toner 18 | B (1.43) | B | C (1.37) | B | B |
| Example 19 | magnetic toner 19 | B (1.43) | B | C (1.37) | B | B |
| Example 20 | magnetic toner 20 | B (1.41) | C | B (1.41) | B | A |
| Example 21 | magnetic toner 21 | B (1.42) | B | C (1.38) | B | A |
| Example 22 | magnetic toner 22 | B (1.43) | B | B (1.43) | B | B |
| Example 23 | magnetic toner 23 | B (1.43) | B | B (1.42) | B | B |
| Example 24 | magnetic toner 24 | A (1.45) | B | A (1.49) | B | A |
| Example 25 | magnetic toner 25 | A (1.48) | B | A (1.48) | B | A |
| Example 26 | magnetic toner 26 | A (1.48) | B | A (1.45) | B | A |
| Example 27 | magnetic toner 27 | A (1.49) | B | A (1.48) | B | C |
| Example 28 | magnetic toner 28 | A (1.49) | B | A (1.45) | B | B |
| Example 29 | magnetic toner 29 | A (1.47) | B | A (1.47) | B | A |
| Example 30 | magnetic toner 30 | A (1.48) | B | A (1.48) | C | A |
| Example 31 | magnetic toner 31 | A (1.45) | B | A (1.49) | C | A |
| Example 32 | magnetic toner 32 | A (1.45) | B | A (1.46) | C | A |
| Example 33 | magnetic toner 33 | A (1.48) | B | A (1.48) | C | C |
| Example 34 | magnetic toner 34 | A (1.45) | B | A (1.45) | C | B |
| Example 35 | magnetic toner 35 | A (1.48) | B | A (1.46) | C | A |
| Example 36 | magnetic toner 36 | A (1.47) | C | A (1.48) | C | A |
| Example 37 | magnetic toner 37 | A (1.48) | C | A (1.45) | C | C |
| Example 38 | magnetic toner 38 | B (1.43) | C | B (1.42) | C | A |
| Example 39 | magnetic toner 39 | B (1.41) | C | B (1.41) | C | C |
| Example 40 | magnetic toner 40 | B (1.42) | C | B (1.43) | C | C |
| Comparative Example 1 | comparative magnetic toner 1 | B (1.41) | C | B (1.42) | D | D |
| Comparative Example 2 | comparative magnetic toner 2 | B (1.40) | C | B (1.40) | D | D |
| Comparative Example 3 | comparative magnetic toner 3 | B (1.42) | C | A (1.47) | D | D |
| Comparative Example 4 | comparative magnetic toner 4 | B (1.42) | C | A (1.48) | D | D |
| Comparative Example 5 | comparative magnetic toner 5 | B (1.43) | C | C (1.37) | D | D |
| Comparative Example 6 | comparative magnetic toner 6 | B (1.42) | C | C (1.38) | D | D |
| Comparative Example 7 | comparative magnetic toner 7 | C (1.37) | C | C (1.36) | D | D |
| Comparative Example 8 | comparative magnetic toner 8 | C (1.36) | C | C (1.36) | D | D |
| Comparative Example 9 | comparative magnetic toner 9 | D (1.32) | D | D (1.31) | D | D |
| Comparative Example 10 | comparative magnetic toner 10 | D (1.30) | D | D (1.32) | D | D |
| Comparative Example 11 | comparative magnetic toner 11 | C (1.36) | D | C (1.36) | D | D |
| Comparative Example 12 | comparative magnetic toner 12 | D (1.30) | D | D (1.30) | D | D |
| Comparative Example 13 | comparative magnetic toner 13 | C (1.38) | D | C (1.38) | D | C |
| Comparative Example 14 | comparative magnetic toner 14 | D (1.30) | D | D (1.30) | D | C |
| Comparative Example 15 | comparative magnetic toner 15 | C (1.38) | D | D (1.31) | D | D |
| Comparative Example 16 | comparative magnetic toner 16 | D (1.32) | C | D (1.32) | D | D |
| Comparative Example 17 | comparative magnetic toner 17 | B (1.42) | D | C (1.37) | D | C |
| Comparative Example 18 | comparative magnetic toner 18 | D (1.32) | C | C (1.38) | D | A |
| Comparative Example 19 | comparative magnetic toner 19 | D (1.30) | C | C (1.36) | D | C |

TABLE 6-continued

| | magnetic toner | initial check image density | initial check electrostatic offset | post-durability test check image density | post-durability test check electrostatic offset | post-durability test check storage stability |
|---|---|---|---|---|---|---|
| Comparative Example 20 | comparative magnetic toner 20 | D (1.32) | C | C (1.37) | D | C |
| Comparative Example 21 | comparative magnetic toner 21 | C (1.36) | C | C (1.35) | D | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-019520, filed Feb. 1, 2012, which is hereby incorporated by reference herein in its entirety.

REFERENCE SIGNS LIST

1: main casing
2: rotating member
3, 3*a*, 3*b*: stirring member
4: jacket
5: raw material inlet port
6: product discharge port
7: center shaft
8: drive member
9: processing space
10: end surface of the rotating member
11: direction of rotation
12: back direction
13: forward direction
16: raw material inlet port inner piece
17: product discharge port inner piece
d: distance showing the overlapping portion of the stirring members
D: stirring member width
100: electrostatic latent image-bearing member (photosensitive member)
102: toner-carrying member (developing sleeve)
103: developing blade
114: transfer member (transfer roller)
116: cleaner
117: charging member (charging roller)
121: laser generator (latent image-forming means, photoexposure apparatus)
123: laser
124: register roller
125: transport belt
126: fixing unit
140: developing device
141: stirring member

The invention claimed is:

1. A magnetic toner comprising magnetic toner particles containing a binder resin and a magnetic body, and inorganic fine particles present on the surface of the magnetic toner particles, wherein;

the inorganic fine particles present on the surface of the magnetic toner particles comprise metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein;

when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the magnetic toner has a coverage ratio A of at least 45.0% and not more than 70.0% and a ratio [coverage ratio B/coverage ratio A] of the coverage ratio B to the coverage ratio A of from at least 0.50 to not more than 0.85, the magnetic toner particle contains a crystalline polyester; and in a differential scanning calorimetric measurement of the magnetic toner, i) the peak temperature (Cm) of the highest endothermic peak originating from the crystalline polyester and obtained during a first temperature ramp up is from at least 70° C. to not more than 130° C., and ii) when ΔH1 is an amount of heat absorption calculated from the area, which is bounded by a differential scanning calorimetric curve "a" that displays the highest endothermic peak originating from the crystalline polyester and obtained during the first temperature ramp up, and the baseline of the differential scanning calorimetric curve "a", and ΔH2 is an amount of heat absorption calculated from the area, which is bounded by a differential scanning calorimetric curve "b" that displays the highest endothermic peak originating from the crystalline polyester and obtained during a second temperature ramp up, and the baseline of the differential scanning calorimetric curve "b", the value obtained by subtracting ΔH2 from ΔH1 is from at least 0.30 J/g to not more than 5.30 J/g.

2. The magnetic toner according to claim 1, wherein the coefficient of variation on the coverage ratio A is not more than 10.0%.

3. The magnetic toner according to claim 1, wherein the magnetic toner comprises a release agent at from at least 1 mass part to not more than 10 mass parts per 100 mass parts of the binder resin, the peak temperature (Wm) of the highest endothermic peak originating from the release agent is at least 40° C., and the Wm and Cm satisfy the following formula (1):

$$35 \leq Cm - Wm \leq 55.$$

* * * * *